United States Patent [19]

Hanaya et al.

[11] Patent Number: 4,838,751

[45] Date of Patent: Jun. 13, 1989

[54] BALE UNPACKING METHOD AND SYSTEM THEREFOR

[75] Inventors: Morimasa Hanaya; Tsunemoto Miura, both of Mishima; Satoru Mamiya, Numazu; Hiroshi Isozaki, Zushi; Kiyoshi Miyajima, Kawasaki, all of Japan

[73] Assignees: Tokushu Paper Manufacturing Co., Ltd., Suntoh; Ishikawajima Industrial Machinery Co., Ltd., Tokyo, both of Japan

[21] Appl. No.: 193,048

[22] Filed: May 12, 1988

[30] Foreign Application Priority Data

Jul. 11, 1985 [JP] Japan ..... 60-249355
Jul. 11, 1985 [JP] Japan ..... 60-249356
Jul. 11, 1985 [JP] Japan ..... 60-249357

[51] Int. Cl.[4] ..... B65B 69/0; B65B 43/28; B65B 43/30

[52] U.S. Cl. ..... 414/412; 83/909; 414/763; 414/744.3; 901/40

[58] Field of Search ..... 414/411, 412, 403, 763, 414/764; 83/909, 926 K; 29/564.3, 426.3, 426.4

[56] References Cited

U.S. PATENT DOCUMENTS 4,414,730 11/1983 Ohmura et al. ..... 29/426.3
4,466,767 8/1984 Meschi ..... 414/411
4,553,312 11/1985 Mitzel et al. ..... 83/909 X
4,592,698 6/1986 Semp et al. ..... 29/564.3 X
4,660,818 4/1987 Conner et al. ..... 29/426.3 X
4,718,157 1/1988 Keyzers et al. ..... 83/909 X

FOREIGN PATENT DOCUMENTS 58-134844 8/1983 Japan .

*Primary Examiner*—Robert J. Spar
*Assistant Examiner*—Gary A. Cundiff
*Attorney, Agent, or Firm*—Cushman, Darby & Cushman

[57] ABSTRACT

In a method of and a system for unpacking bales each tied by at least one strap, a contact plate member provided with a strap sensor unit is mounted, through a biasing arrangement, on a body frame for movement relative thereto. The body frame is moved toward a confronting side face of the bale to bring the contact plate member into contact with the side face of the bale. The body frame is further moved toward the bale while increasing biasing force of the biasing arrangement, until contact pressure, with which the contact plate member is urged against the side face of the bale, reaches a predetermined value. When the contact plate member is urged by the bale in such a direction as to increase the biasing force during scanning of the strap sensor unit along the side face of the bale, the body frame is moved away from the bale to maintain the contact pressure at the predetermined value. When the strap sensor unit detects a position of the strap of the bale, the body frame is moved to bring a strap handling unit such as cutter or clamps mounted on the body frame, into engagement with the strap.

34 Claims, 14 Drawing Sheets

BALE UNPACKING METHOD AND SYSTEM THEREFOR

BACKGROUND OF THE INVENTION

The present invention relates to a method of and a system for unpacking bales such as, for example, pulp bales.

In a paper-making plant having no pulp manufacturing installation, in general, pulp in the form of sheets is carried to the paper-making plant from a pulp-making plant, the pulp in the form of sheets is dissociated by a pulper, and the dissociated pulp is used as raw material.

As shown in FIG. 1, the pulp formed by a stack of pulp sheets is carried and stored in the form of a so-called pulp bale 1. In the pulp bale 1, a pair of first and second packaging sheets 1*a* and 1*b* wrap up respectively upper and lower portions of the stack of pulp sheets. A plurality of wire bands 1*c* extending in vertical planes perpendicular to each other tie the stack of pulp sheets through the first and second packaging sheets 1*a* and 1*b*. When it is desired to feed the pulp in the form of the pulp bale 1 into the pulper and to subject the pulp to a dissociation treatment, it is necessary to carry out, by operators' hands, the removal operation of the wire bands 1*c* from the pulp bale 1 and the removal operation of the packaging sheets 1*a* and 1*b* from the stack of sheets.

In recent years, the paper-making plant has become considerably large in scale. In such papermaking plant large in scale, it has been requested to carry out the above-mentioned unpacking operation of the pulp bales 1 automatically without relying upon the operators' hands, in order to efficiently supply a large quantity of pulp raw material. A method of and a system for unpacking pulp bales, which fulfill the above request, have been proposed in Japanese Pat. Application No. 57-9752 said open under No. 58-134844 on Aug. 11, 1983 and the like.

Specifically, as shown in FIG. 2, the unpacking system disclosed in the above-mentioned Japanese patent application comprises a roller conveyer 2 for transporting the pulp bales 1 from below to above as viewed in FIG. 2. A centering device 3 is provided for centering the pulp bales 1 widthwise of the roller conveyer 2. The wire bands 1*c* are cut by a wire cutting machine 4, and the cut wire bands 1*c* are drawn and removed out of the pulp bale 1 by a wire removing machine 5. A first vacuum-holding machine 6A is provided for reciprocative movement in a direction intersected with the roller conveyer 2. The first vacuum-holding machine 6A is so arranged as to apply negative pressure to the first packaging sheet 1*a* to hold the same, and to move the first packaging sheet 1*a* held under the suction pressure upwardly from the bale 1, thereby removing the first packaging sheet 1*a* from the bale 1. Then, the bale 1 having removed therefrom the first packaging sheet 1*a* is turned upside down by an inverting machine 7, which is arranged to surround the roller conveyer 2, such that the second packaging sheet 1*b* is located at the top of the bale 1 turned upside down. A second vacuum-holding machine 6B is arranged downstream of the inverting machine 7. The second vacuum-holding machine 6B applies negative pressure to the second packaging sheet 1*b* to hold the same, and to move the second packaging sheet 1*b* upwardly from the pulp bale 1 thereby removing the second packaging sheet 1*b* from the pulp bale 1, to expose the stack of pulp sheets. Thus, the unpacking operation of the pulp bale 1 is completed.

By the way, it is necessary to make the wire cutting machine 4 and the wire removing machine 5 correctly grasp the positions of the respective wire bands 1*c* of the pulp bale 1, in order to cut the wire bands 1*c* by the wire cutting machine 4 and to draw and remove the cut wire bands 1*c* out of the pulp bale 1 by the wire removing machine 5.

Conventional, metal detecting means such as a magnetic sensor is employed to detect the position of the wire bands 1*c*. That is, the metal detecting means is moved horizontally along a confronting side face of the pulp bale 1 to scan the confronting side face. As indicated by the phantom lines in FIG. 2, however, if the confronting side face of the pulp bale 1 is inclined with respect to the direction in which the metal detecting means moves to scan the confronting side face of the pulp bale 1, the metal detecting means might be caught by the confronting side face of the pulp bale 1. This makes it difficult that the metal detecting means moves to scan the confronting side face of the pulp bale 1.

Further, as described previously, the packaging sheets 1*a* and 1*b* are removed from the pulp bale 1 by the vacuum-holding machines 6A and 6B. Each of the vacuum-holding machines 6A and 6B comprises a vacuum-holding head which is provided with a plurality of suction pads. When the negative pressure is applied to the packaging sheets, for example, to the first packaging sheet 1*a* through the suction pads, air is drawn from spaces between the first packaging sheet 1*a* and the top pulp sheet of the stack and between each pair of adjacent pulp sheets at the top of the stack, to bring the spaces to negative pressure. This causes the first packaging sheet 1*a* to be brought into close contact with the several upper pulp sheets of the stack, making it difficult to separate the first packaging sheet 1*a* from the stack of sheets. By this reason, as the first packaging sheet 1*a* is moved upwardly by the vacuum-holding head, the several upper pulp sheets are held under vacuum against the first packaging sheet 1*a* and are removed together with the first packaging sheet 1*a* out of the stack of sheets. Alternatively, the several pulp sheets held under vacuum against the first packaging sheet 1*a* fall down onto the stack of sheets during upward movement of the first packaging sheet 1*a*, causing the stack of sheets to get out of shape. This is an obstacle to transfer of the stack of sheets to the subsequent processing step.

Moreover, the pulp bale 1 has, on or in its surface, a large number of damages due to various shocks during transportation, and a large number of recesses or indentations due to tying-up of the pulp bale 1 by the wire bands 1*c*. Because of such damages and recesses, the suction pads of the vacuum-holding machines 6A and 6B cannot be brought into sealing contact with the packaging sheets 1*a* and 1*b*. This makes it impossible to apply sufficient negative pressure to the packaging sheets 1*a* and 1*b* through the suction pads. Thus, there is an anxiety that the packaging sheets 1*a* and 1*b* are not vacuum-attracted to the suction pads.

SUMMARY OF THE INVENTION

It is an object of the invention to provide a method of unpacking bales each having an article, a packaging sheet material wrapping up the article and at least one strap extending around the article in a vertical plane to tie the article through the packaging sheet material, in which it is possible to ensure detection of a position of the strap, regardless of a posture of the bale on a predetermined path along which the bales are transported, thereby improving an efficiency of an unpacking operation.

It is another object of the invention to provide the bale unpacking method which can facilitate removal of the packaging sheet material from the bale.

It is still another object of the invention to provide a system for carrying out the bale unpacking method.

It is another object of the invention to provide the system comprising packaging-sheet removing means having at least one vacuum holder, in which it is possible to ensure vacuum-attraction of the packaging sheet material to the vacuum holder, regardless of irregularities on the surface of the bale.

According to the invention, there is provided a method of unpacking bales each having an article, a packaging sheet material wrapping up the article and at least one strap extending around the article in a vertical plane to tie the article through the packaging sheet material, the method comprising the steps of:

(a) transporting the bales one by one along a predetermined path;

(b) cutting the strap of the bale on the predetermined path;

(c) removing the cut strap from the bale; and (d) removing the packaging sheet material from the bale having removed therefrom the strap, to expose the article, wherein at least one of the steps (b) and (c) includes the steps of:

(i) preparing a body frame capable of being translated along the predetermined path and movable toward and away from a side face of the bale on the predetermined path, the side face being confronted with the body frame, strap handling means mounted on the body frame for handling the strap of the bale, a contact plate member mounted on the body frame for movement relative thereto toward and away from the side face of the bale, biasing means mounted between the contact plate member and the body frame for biasing the contact plate member relatively to the body frame toward the side face of the bale, and sensor means mounted on the contact plate member for detecting a position of the strap of the bale;

(ii) moving the body frame together with the contact plate member toward the side face of the bale to bring the contact plate member into contact with the side face of the bale, continuing to move the body frame toward the side face of the bale while increasing biasing force of the biasing means until contact pressure, with which the contact plate member is urged by the biasing means against the side face of the bale, reaches a predetermined value, and halting movement of the body frame toward the side face of the bale when the contact pressure reaches the predetermined value;

(iii) translating the body frame together with the contact plate member along the predetermined path while maintaining the pressure contact member in contact with the side face of the bale, to cause the sensor means to scan the side face of the bale for detecting the position of the strap of the bale;

(iv) when the contact plate member is urged by the side face of the bale, during the scanning of the sensor means, in such a direction as to increase the biasing force of the biasing means, moving the body frame away from the side face of the bale to maintain the contact pressure at the predetermined value; and (v) when the sensor means detects the position of the strap of the bale, moving the body frame toward the side face of the bale while maintaining the contact plate member in contact with the side face of the bale, to bring the strap handling means into engagement with the strap of the bale.

Preferably, the above-mentioned step (d) includes the steps of moving the packaging sheet material upwardly from the article, and moving the packaging sheet material downwardly at least once during the upward movement of the packaging sheet material, to introduce air into a space between the packaging sheet material and the article.

According to the invention, there is also provided a system for unpacking bales each having an article, a packaging sheet material wrapping up the article and at least one strap extending around the article in a vertical plane to tie the article through the packaging sheet material, the system comprising:

means for transporting the bales one by one along a predetermined path;

cutting means arranged in facing relation to the predetermined path for cutting the strap of the bale on the predetermined path;

strap removing means arranged in facing relation to the predetermined path for removing the cut strap from the bale; and packaging-sheet removing means for removing the packaging sheet material from the bale having removed therefrom the strap, wherein at least one of the cutting means and the strap removing means includes an operating apparatus which comprises:

a movable frame capable of being translated along the predetermined path;

a body frame mounted on the movable frame for movement relative thereto toward and away from a side face of the bale on the predetermined path, the side face being confronted with the body frame;

strap handling means mounted on the body frame for handling the strap of the bale;

a contact plate member mounted on the body frame for movement relative thereto toward and away from the side face of the bale;

biasing means mounted between the contact plate member and the body frame for biasing the contact plate member relatively to the body frame toward the side face of the bale;

sensor means mounted on the contact plate member for detecting a position of the strap of the bale;

detecting means for detecting a position of the contact plate member relative to the body frame;

first drive means for translating the movable frame along the predetermined path; and second drive means for moving the body frame relatively to the movable frame toward and away from the side face of the bale, wherein the second drive means moves the body frame together with the contact plate member toward the side face of the bale to bring the contact plate member into contact with the side face of the bale, and the second drive means continues to move the body frame toward the side face of the bale while increasing biasing force of the biasing means until the body frame moves to a predetermined position relative to the contact plate member where the contact plate member is urged by the biasing means against the side face of the bale with a predetermined contact pressure, wherein the detecting means detects movement of the body frame to the predetermined position, to generate a first signal, and the second drive means is rendered inoperative in response to the first signal from the detecting means to halt movement of the body frame toward the side face of the bale, wherein the first drive means translates the movable frame together with the body frame and the contact plate member along the predetermined path while maintaining the pressure contact member in contact with the side face of the bale, to cause the sensor means to scan the side face of the bale for detecting the position of the strap of the bale, wherein when the contact plate member is urged by the side face of the bale, during the scanning of the sensor means, and is moved relatively to the body frame in such a direction as to increase the biasing force of the biasing means, the detecting means detects the movement of the contact plate member relative to the body frame to generate a second signal, and the second drive means is rendered operative in response to the second signal from the detecting means to move the body frame away from the side face of the bale to the predetermined position, thereby maintaining the predetermined contact pressure, and wherein when the sensor means detects the position of the strap of the bale to generate a signal, the second drive means is rendered operative in response to the signal from the sensor means to move the body frame toward the side face of the bale while maintaining the contact plate member in contact with the side face of the bale, to bring the strap handling means into engagement with the strap of the bale.

If the packaging sheet material has a first packaging sheet wrapping up an upper portion of the article and a second packaging sheet wrapping up a lower portion of the article, the system should include inverting means for turning the bale upside down, and the packaging-sheet removing means should include at least one vacuum holder, suction means connected to the vacuum holder for supplying negative pressure to the same, and elevating means for moving the vacuum holder vertically toward and away from the bale. The arrangement is such that the elevating means moves the vacuum holder downwardly to bring the same into engagement with a top of the bale, the suction means applies the negative pressure to the first packaging sheet through the vacuum holder to attract the first packaging sheet to the vacuum holder, the elevating means moves the vacuum holder upwardly to remove the first packaging sheet from the article, the inverting means turns the bale upside down, the elevating means moves the vacuum holder downwardly to bring the same into engagement with a top of the bale turned upside down, the suction means applies the negative pressure to the second packaging sheet through the vacuum holder to attract the second packaging sheet to the vacuum holder, and the elevating means moves the vacuum holder upwardly to remove the second packaging sheet from the article. In this case, it is preferable that the vacuum holder includes a resiliently deformable suction pad having a pair of inner and outer tubular portions, provided in concentric relation to each other in cross-section in a plane perpendicular to an axis common to the inner and outer tubular portions, the inner and outer tubular portions cooperating with each other to define therebetween an annular pocket, the outer tubular portion having one end thereof connected to the inner tubular section and the other opening end face which projects beyond an adjacent opening end face of the inner tubular portion.

DETAILED DESCRIPTION

Figure 3:
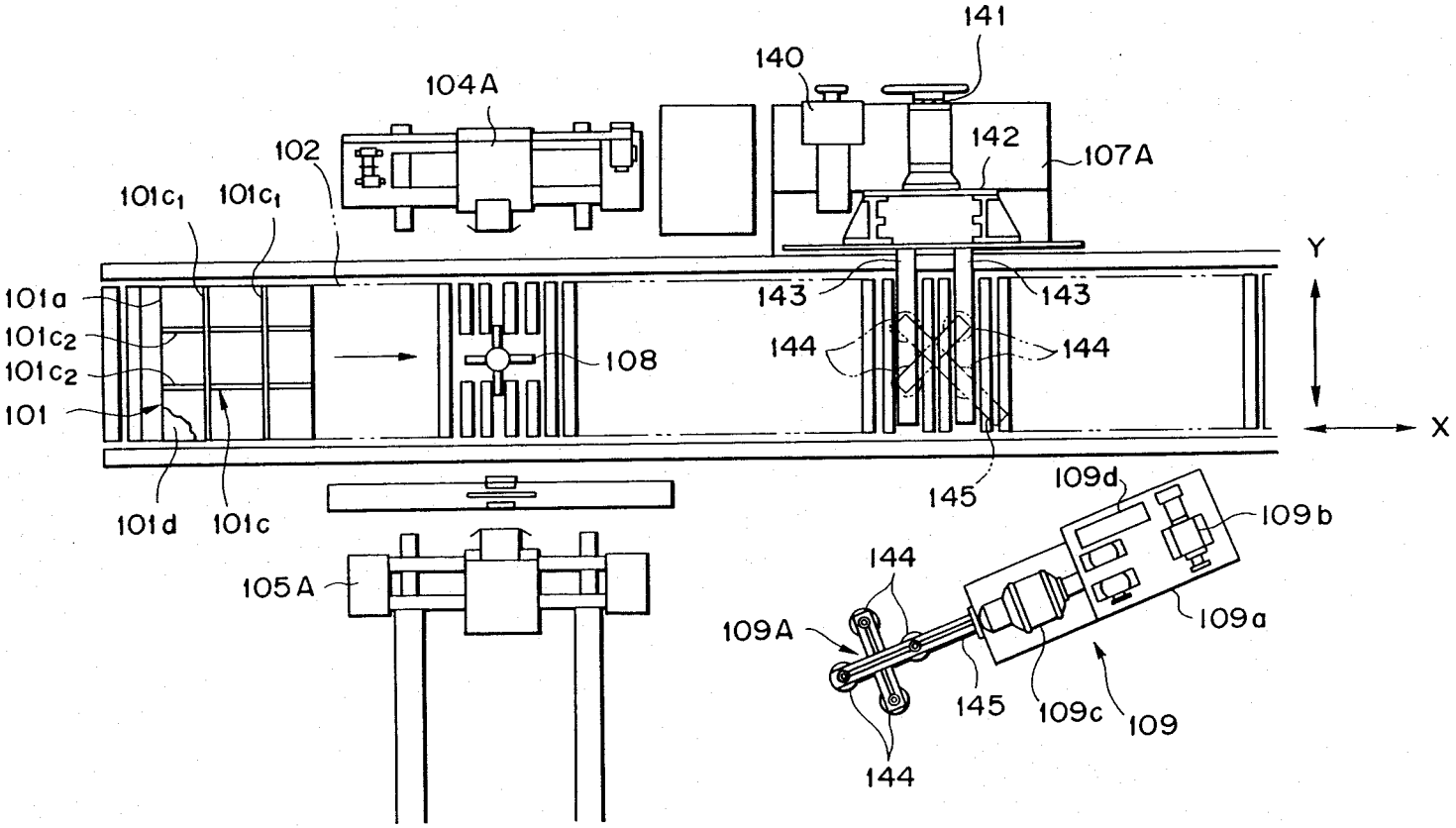
FIG. 3 is a top plan view of a bale unpacking system according to an embodiment of the invention.

Referring to FIG. 3, there is shown the entirety of a system for unpacking bales 101 such as pulp bales (only one shown in FIG. 3), according to an embodiment of the invention. Each of the bales 101 has an article **101*d*** such as a stack of pulp sheets, a packaging sheet material wrapping up the article 101*d*, and a plurality of straps 101*c* such as metallic wire bands extending around the article 101*d* in a vertical plane to tie the article 101*d* through the packaging sheet material. The packaging sheet material is composed of a first packaging sheet 101*a* wrapping up an upper portion of the article 101*d* and a second packaging sheet 101*b* wrapping up a lower portion of the article 101*d*, as clearly shown in FIG. 12. The straps 101*c* include a pair of straps $101c_1$ extending in a first vertical plane and a pair of straps $101c_2$ extending in a second vertical plane perpendicular to the first vertical plane.

The bale unpacking system illustrated in FIG. 3 is similar in basic arrangement to that disclosed in Japanese Pat. Application Nos. 59-156664 and 59-156665. The bale unpacking system comprises a roller conveyer 102 defining a predetermined path along which the bales 101 are transported. The roller conveyer 102 also serves to transport the bales 101 one by one along the predetermined path.

A bale turner 108 movable up and down is arranged in the predetermined path for turning the bale 101 about a vertical axis through 90 degrees. At the bale turner 108, a strap cutting machine 104A is arranged in facing relation to the predetermined path, for cutting the straps 101*c* of the bale 101. A strap removing machine 105A is arranged in facing relation to the strap cutting machine 104A with the roller conveyer 102 therebetween, for removing the straps 101*c* cut by the strap cutting machine 104A. A bale inverter 107A is arranged downstream of the strap cutting machine 104A and the strap removing machine 105A with reference to the transport direction of the bales 101 along the predetermined path. The bale inverter 107A is adapted to clamp the bale 101 and to turn the same upside down about the horizontal axis extending perpendicularly to the predetermined path. A packaging-sheet removing machine 109 is arranged in substantially facing relation to the bale inverter 107A with the roller conveyer 102 therebetween. The packaging-sheet removing machine 109 is angularly movable in the horizontal plane between a position indicated by the solid lines in FIG. 3 where a vacuum-holding head 109A is located remote from the roller conveyer 102 and a position indicated by the phantom lines in FIG. 3 where the vacuum-holding head 109A is located above the bale 101 on the roller conveyer 102.

The above various components of the bale unpacking system will be individually described below in detail.

Figure 4:
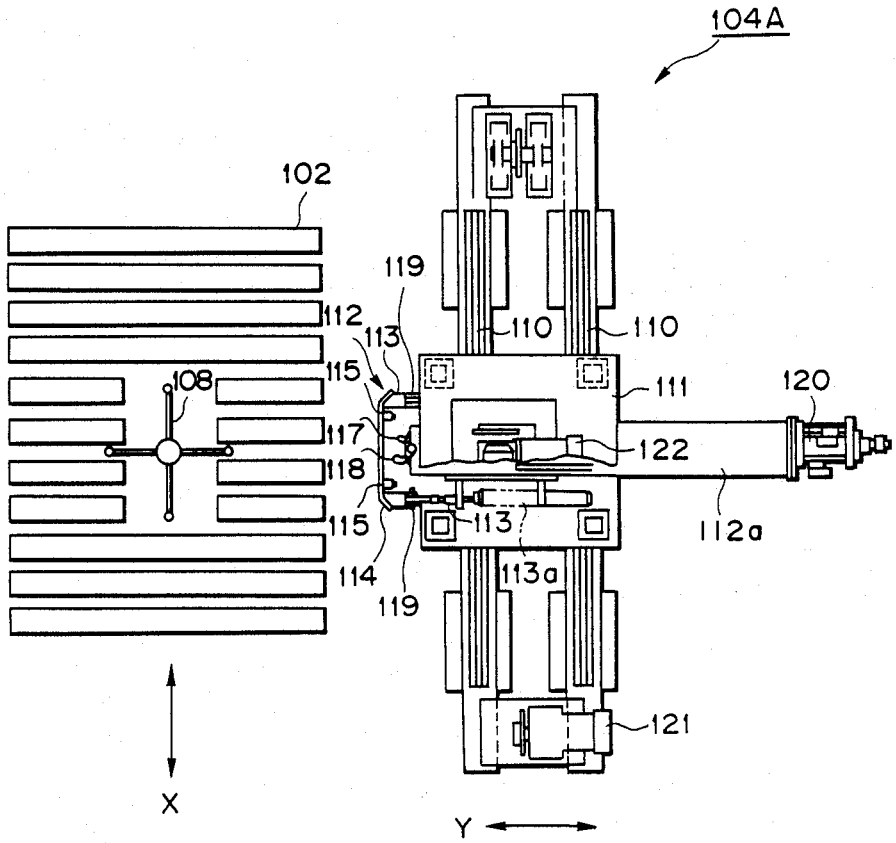
FIG. 4 is a fragmental top plan view of the bale unpacking system illustrated in FIG. 3, showing a strap cutting machine.
Figure 5:
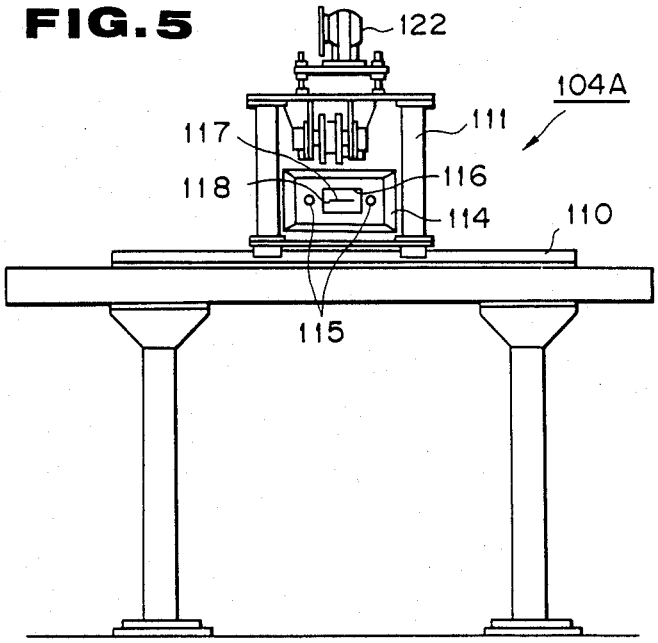
FIG. 5 is a front elevational view of the strap cutting machine illustrated in FIG. 4.
Figure 6:
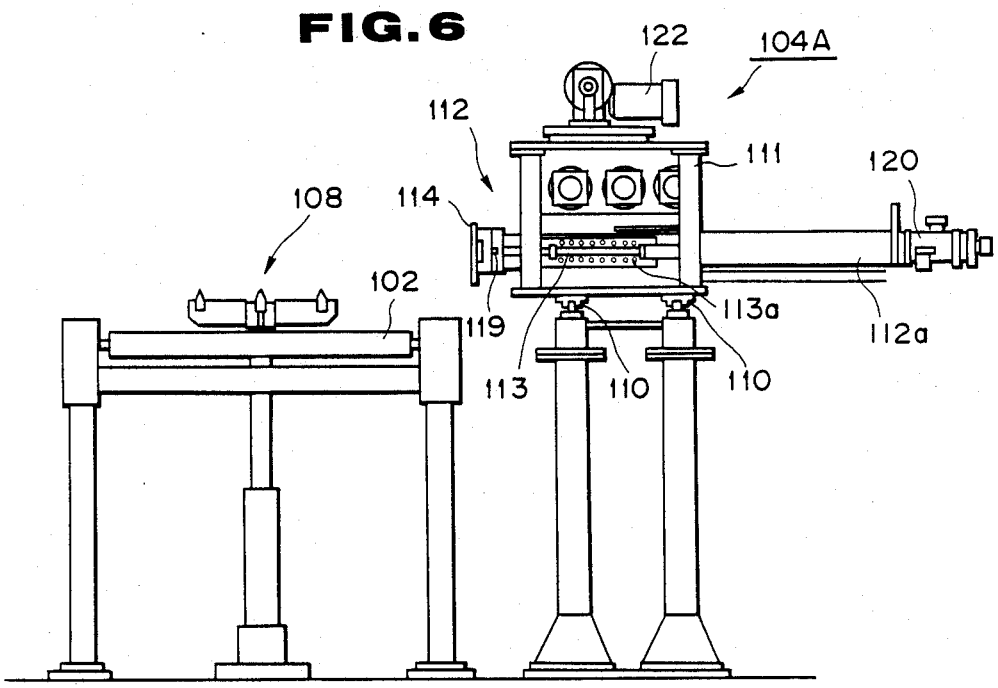
FIG. 6 is a side elevational view of the strap cutting machine illustrated in FIGS. 4 and 5.

As shown in FIGS. 4 through 6, the strap cutting machine 104A comprises a pair of spaced rails 110 and 110 extending horizontally in a direction (hereinafter referred to as "X-axis direction") parallel to the predetermined path defined by the roller conveyer 102. The strap cutting machine 104A comprises an operating apparatus which includes a movable frame 111 mounted on the rails 110 and 110 and adapted to be driven by a motor 121 such that the movable frame 111 is translated along the rails 110 and 110. The operating apparatus further includes a cutter head assembly 112 mounted on the movable frame 111 for horizontal movement relative thereto in a direction (hereinafter referred to as "Y-axs direction") toward and away from a side face 101*e* (see FIG. 7) of the bale 101, which is confronted with the cutter head assembly 112.

The cutter head assembly 112 comprises a body frame 112*a* mounted on the movable frame 111 and adapted to be driven by a motor 122 for movement relative to the movable frame 111 in the Y-axis direction. A pair of rods 113 and 113 are mounted on the body frame 112A for movement relative thereto in the Y-axis direction. A contact plate member 114 is connected to forward ends of the respective rods 113 and 113. A pair of magnetic sensors 115 and 115 are mounted to the contact plate member 114. A strap handling equipment is mounted to a forward end of the body frame 112*a*. The strap handling equipment is formed by a cutter like scissors having a pair of cutting blades 117 and 118. Subsequently to be described in detail, when the body frame 112*a* is moved by the motor 122 in the Y-axis direction, the cutter blades 117 and 118 mounted to the body frame 112*a* move through an opening 116 (see FIG. 5) formed in the contact plate member 114 and are brought into engagement with the strap 101*c* of the bale 101. As the cutter blades 117 and 118 are brought into engagement with the strap 101*c*, a hydraulic cylinder 120 mounted on the body frame 112*a* is actuated to close the cutter blades 117 and 118 to cut the strap 101*c*. The forward ends of the respective rods 113 and 113 are pivotally connected respectively to the opposite lateral side edges of the contact plate member 104 through respective pivot pins 119 and 119 having their respective axes extending in the X-axis direction. By these pivot pins 119 and 119, the contact plate member 114 is made movable pivotally so that the contact plate member 114 can be changed in angle correspondingly to a posture of the bale 101 on the roller conveyer 102 or to irregularities on the confronting side face 101*e* of the bale 101.

The operating apparatus of the strap cutting machine 104A further comprises a control mechanism for maintaining, at an appropriate predetermined value, contact pressure with which the contact plate member 114 is in contact with the confronting side face 101*e* of the bale 101.

Figure 7:
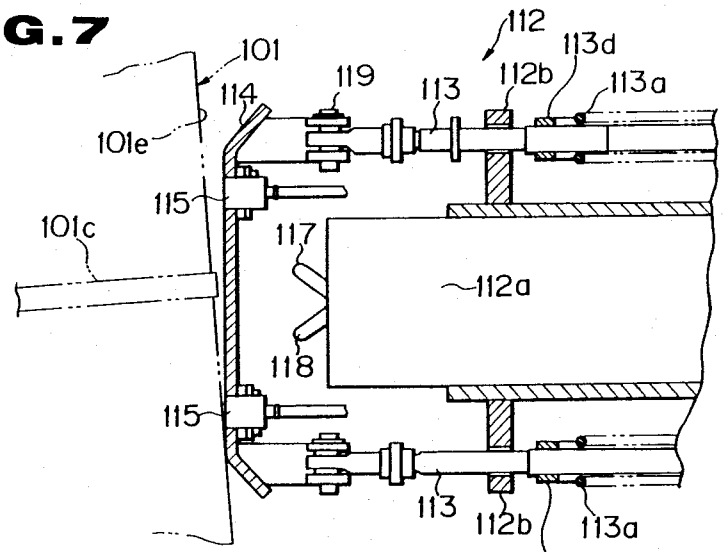
FIG. 7 is an enlarged fragmental view of a cutter head assembly of the strap cutting machine illustrated in FIGS. 4 through 6.
Figure 8:
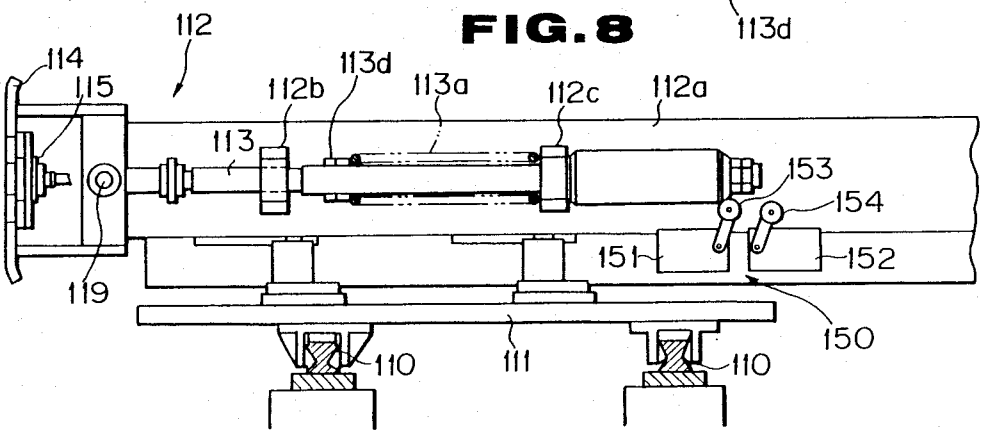
FIG. 8 is a side elevational view of the cutter head assembly illustrated in FIG. 7.

Specifically, as shown in FIGS. 7 and 8, the aforesaid pair of rods 113 and 113 are supported by the body frame 112*a* for movement in the Y-axis direction, through respective pairs of support arms 112*b* and 112*c* and 112*b* and 112*c*. Each pair of support arms 112*b* and 112*c* are fixedly mounted to the body frame 112*a* and are spaced from each other along the body frame 112*a*. A pair of biasing means or coil springs 113*a* and 113*a* are provided, each of which is mounted about a corresponding one of the rods 113 and which is interposed under compression between a corresponding one of the support arms 112*c* and a spring retainer 113*d* fixedly secured to the corresponding rod 113, for biasing the corresponding rod 113 toward the confronting side face 101*e* of the bale 101. In addition, a position detector 150 is associated between the body frame 112*a* and one of the pair of rods 113, for detecting a position of the contact plate member 114 connected to the rods 113 and 113, relative to the body frame 112*a*. The position detector 150 has a pair of position sensors 151 and 152 such as limit switches which are fixedly mounted to the body frame 112*a* and which are spaced from each other a predetermined distance along the Y-axis direction. The position sensors 151 and 152 are electrically connected to the motor 122 (see FIG. 4) for the body frame 112*a*. The position sensors 151 and 152 have their respective actuator pins 153 and 154 which can be depressed by the rearward end of the rod 113 when the same moves relatively to the body frame 112*a* in the Y-axis direction. That is, the arrangement is such that the position sensor 151 normally sends an ON-signal to the motor 122 and sends an OFF-signal to the motor 122 when the actuator pin 153 is depressed by the rod 113, while the position sensor 152 normally sends an OFF-signal to the motor 122 and sends an ON-signal to the motor 122 when the actuator pin 154 is depressed by the rod 113. On the basis of these signals from the position sensors 151 and 152, it is judged whether or not the position of the magnetic sensors 115 and 115 mounted to the contact plate member 114, relative to the confronting side face 101*e* of the bale 101 is appropriate. That is, the motor 122 is operated in response to the signals from the position sensors 151 and 152 to move the body frame 112*a* forwardly and rearwardly in the Y-axis direction.

Figure 9:
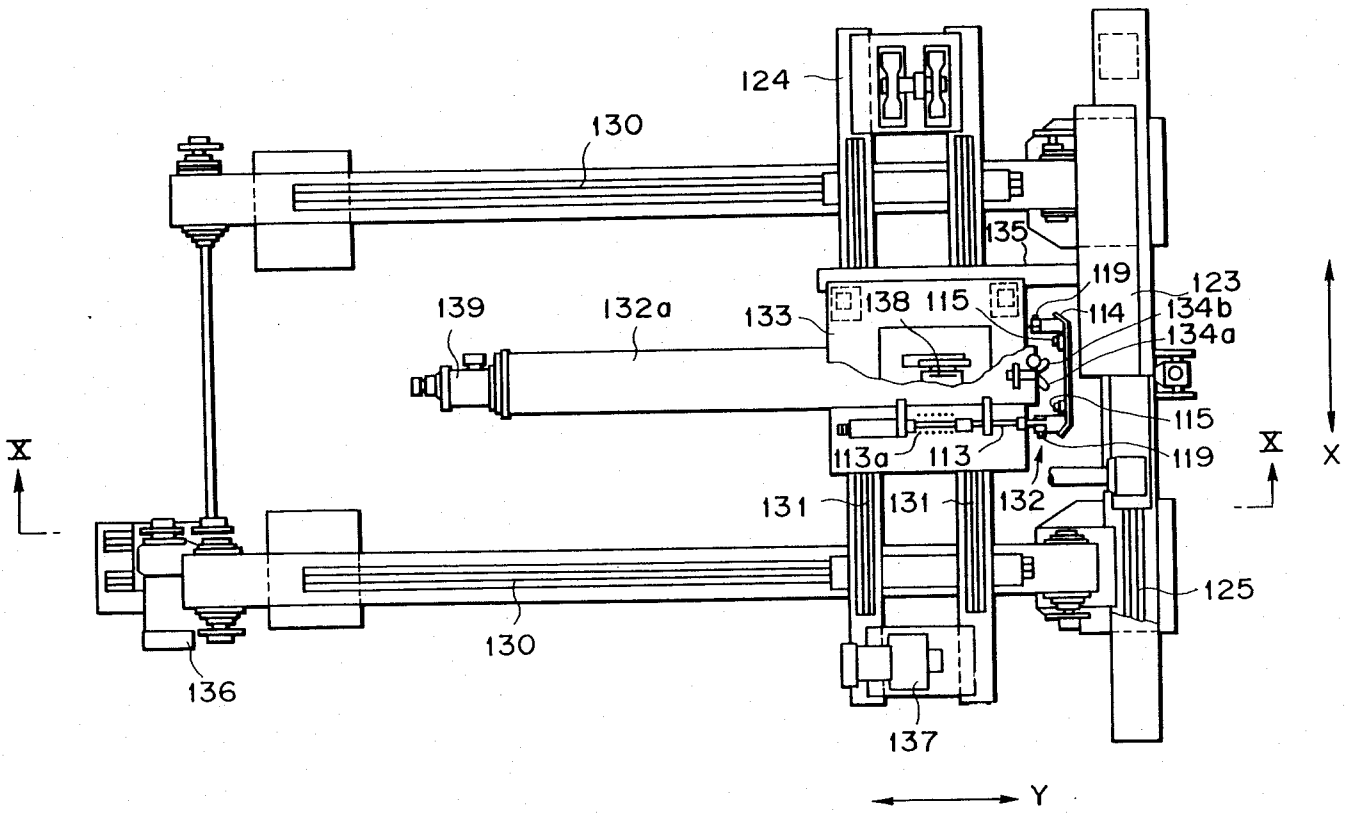
FIG. 9 is a top plan view of a strap removing machine illustrated in FIG. 3.
Figure 10:
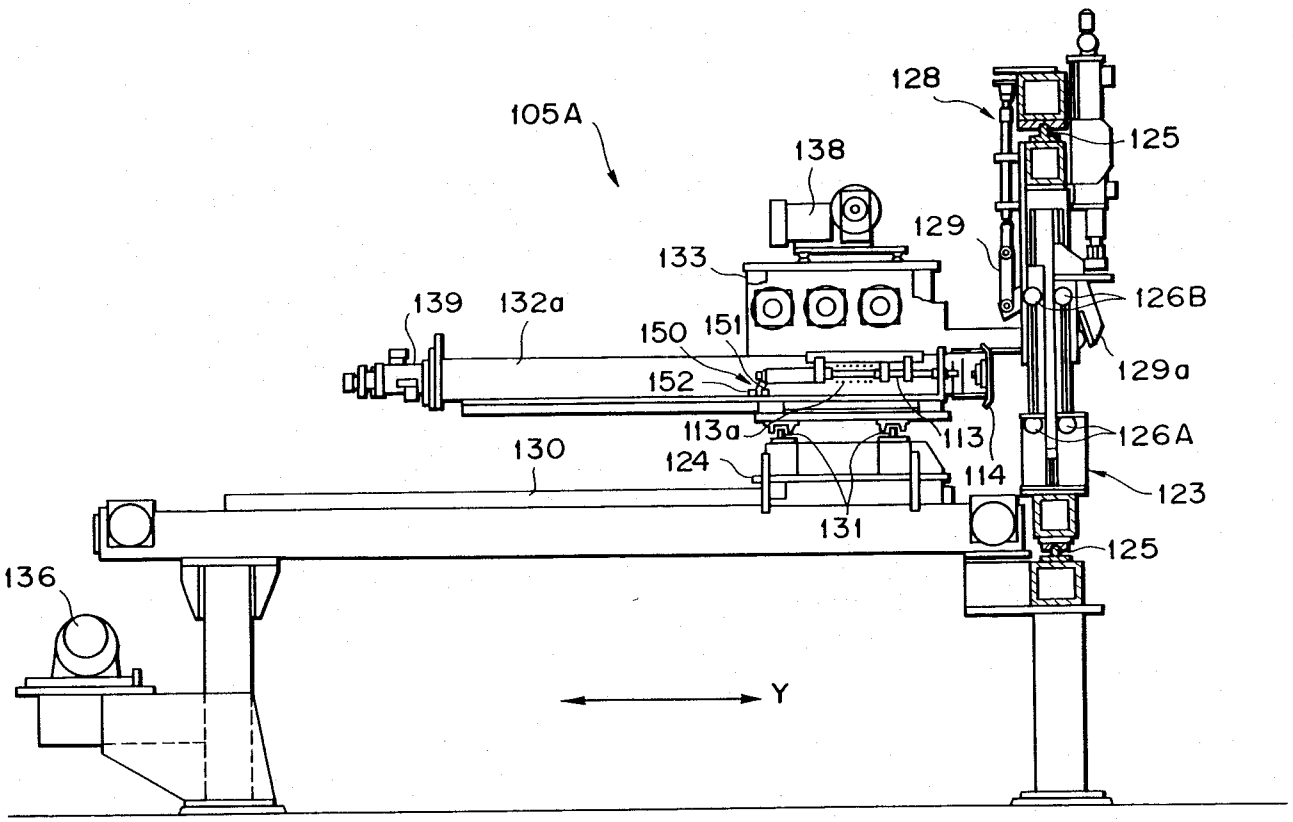
FIG. 10 is a cross-sectional view taken along the line X—X in FIG. 9.
Figure 11:
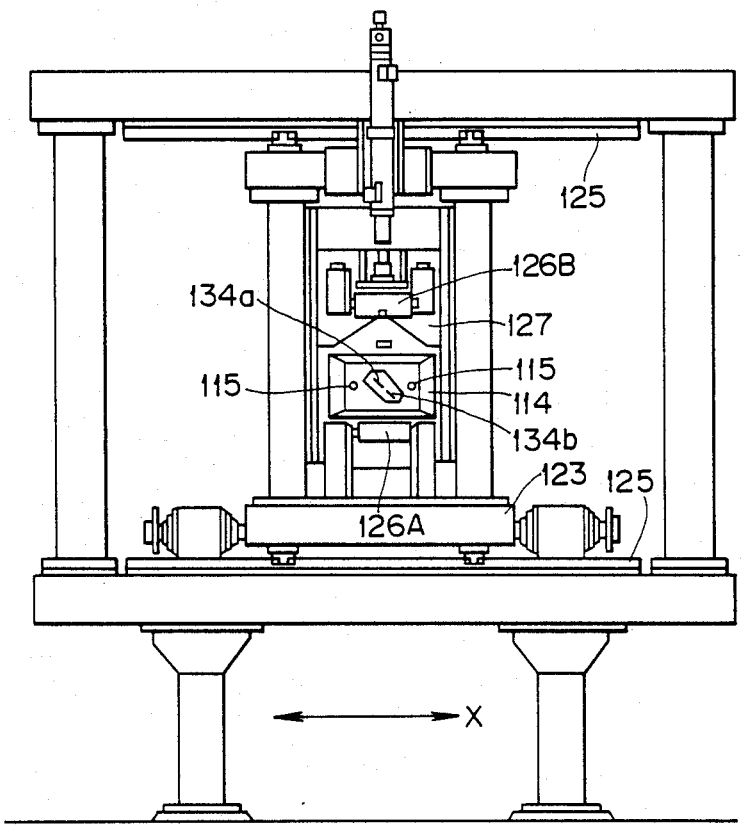
FIG. 11 is a front elevational view of the strap removing machine illustrated in FIGS. 9 and 10.

The strap removing machine 105A comprises a guide frame 123 and a main frame 124, as shown in FIGS. 9 through 11.

The guide frame 123 is supported by a pair of vertically spaced upper and lower guide rails 125 and 125 for movement in the X-axis direction, and is restricted in vertical movement by the upper and lower guide rails 125 and 125. Mounted to the guide frame 123 are a pair of stationary guide rolls 126A and 126A and a pair of vertically movable guide rolls 126B and 126B, for guiding the strap 101*c* drawn and removed out of the bale 101 subsequently to be described. A pair of upper and lower guide plates 127 (lower one is omitted from illustration for clarification) are associated respectively with the pair of stationary guide rolls 126A and 126A and the pair of movable guide rolls 126B and 126B. The guide plates 127 have their respective slide surfaces for guiding the strap 101*c* to the widthwise central portions of the respective pairs of guide rolls 126A and 126B. Also mounted on the guide frame 123 are a brake device 128 for regulating movement of the guide frame 123 relative to the guide rails 125 and 125, and a break releasing mechanism 129 for operating the brake device 128.

The main frame 124 is mounted on a pair of spaced rails 130 and 130 extending horizontally in the Y-axis direction. The main frame 124 is adapted to be moved by a motor 136 along the rails 130 and 130. A pair of spaced rails 131 and 131 extending in the X-axis direction are mounted on the main frame 124.

The strap removing machine 105A comprises an operating apparatus which includes a movable frame 133 mounted on the rails 131 and 131 and adapted to be driven by a motor 137 for movement along the rails 131 and 131. A drawing head assembly 132 is supported on the movable frame 133.

Like the cutter head assembly 112 of the strap cutting machine 104A described previously, the drawing head assembly 132 comprises a body frame 132*a* mounted on the movable frame 133 and adapted to be driven by a motor 138 for movement relative to the movable frame 133 in the Y-axis direction. The drawing head assembly 132 has component parts like or similar to those of the cutter head assembly 112, and such like or similar component parts are designated by the like or similar reference numerals to avoid repetition. That is, the drawing head assembly 132 comprises a pair of rods 113 and 113, a contact plate member 114 connected to forward ends of the respective rods 113 and 113 through respective pivot pins 119 and 119, and a pair of magnetic sensors 115 and 115 mounted to the contact plate member 114. Also like the cutter head assembly 112, a pair of biasing means or coil springs 113*a* and 113*a* (only one seen in FIGS. 7 through 9) are interposed between the respective rods 113 and 113 and the movable frame 132*a*. Unlike the cutter head assembly 112, a strap handling equipment mounted to the forward end of the body frame 132*a* is formed by a pair of clamps 134*a* and 134*b* which are capable of being closed to clamp the cut strap 101*c* of the bale 101 when the clamps 134*a* and 134*b* are operated by a hydraulic motor 139. As clearly shown in FIG. 11, the pair of clamps 134*a* and 134*b* are inclined with respect to the horizontal plane and to the vertical plane, in order to prevent the strap 101*c* from being caught by the clamps 134*a* and 134*b* when the strap 101*c* is drawn and removed out of the bale 101.

An operating rod 135 projects forwardly from the movable frame 133. When the main frame 124 is driven by the motor 136 and is moved forwardly in the Y-axis direction, that is, toward the roller conveyer 102, the operating rod 135 is brought into engagement with a pivotal arm 129*a* connected to the brake release mechanism 129, to release braking of the guide frame 123 with respect to the guide rails 125 and 125. In addition, the operating rod 135 is in engagement with a part of the guide frame 123 to connect the same to the main frame 124, thereby enabling the guide frame 123 to be moved together with the main frame 124.

Also like the cutter head assembly 112, as shown in FIGS. 9 and 10, a position detector 150 composed of a pair of position sensors 151 and 152 is associated between the body frame 132*a* and one of the pair of rods 113, for detecting a position of the contact plate member 114 connected to the rods 113 and 113, relative to the body frame 132*a*. The position sensors 151 and 152 are electrically connected to the motor 138 for the body frame 132*a*. In a manner like the case of the cutter head assembly 112, the motor 138 is operated in response to signals from the position sensors 151 and 152 to move the body frame 132*a* forwardly and rearwardly in the Y-axis direction. Thus, contact pressure of the contact plate member 104 with the confronting side face of the bale 101 can be maintained at an appropriate predetermined value, regardless of a posture of the bale 101 on the roller conveyer 102.

Referring back to FIG. 3, the inverter 107A arranged downstream of the strap cutting machine 104A and the strap removing machine 105A comprises a frame 142 driven by a motor 140 so as to be angularly moved about a horizontal axis of a shaft 141. A pair of upper forks 143 and 143 and a pair of lower forks (not shown) are mounted to the frame 142 and extend perpendicularly to the predetermined path defined by the roller conveyer 102. The pair of upper forks 143 and 143 are mounted to the frame 142 for movement relative thereto to a position above the operating range of the packaging-sheet removing machine 109 so as not to interfere with the operation of the same. The upper and lower pairs of forks 143 and 143 cooperate with each other to vertically clamp the bale 1 and to turn the same upside down about the horizontal axis.

Figure 12:
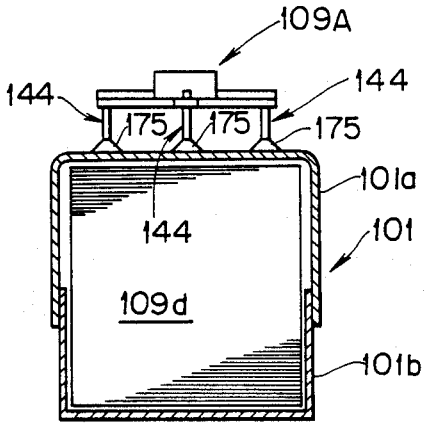
FIG. 12 is a front elevational view of a vacuum-holding head of a packaging-sheet removing machine illustrated in FIG. 3, packaging sheets of a bale being shown in cross-section.

Referring to FIGS. 3 and 12, the packaging sheet removing machine 109 comprises a body 109*a* adapted to be angularly moved by a motor 109*b* about the vertical axis between a position indicated by the solid lines in FIG. 3 and a position indicated by the phantom lines in FIG. 3. The vacuum-holding head 109A comprises a frame 145 mounted to the body 109*a* and adapted to be driven by a motor 109*c* for vertical movement relative to the body 109*a*. A plurality of, for example, four vacuum holders 144 are mounted to the frame 134 and depend therefrom. The vacuum holders 144 are connected to a vacuum source 109*d* such as a turbo-blower or the like mounted on the body 109*a* through a valve 109*e* (see FIG. 13). In the position indicated by the phantom lines in FIG. 3, the vacuum holders 144 are brought into engagement with the packaging sheet material of the bale 101, as shown in FIG. 12. Negative pressure from the vacuum source 109*d* is applied to the packaging sheet material of the bale 101 through the respective vacuum holders 144 to vacuum-attract the packaging sheet material to the vacuum holders 144. The frame 145 is moved by the motor 109*c* upwardly to remove the packaging sheet material from the bale 101. The frame 145 is angularly moved by the motor 109*b* about the vertical axis to move the vacuum holders 144 having vacuum-attracted thereto the packaging sheet material, to the position indicated by the solid lines in FIG. 3 where the valve 109*e* intercepts communication between the vacuum source 109*d* and the respective vacuum holders 144 to release the packaging sheet material from the vacuum holders 144.

Figure 13:
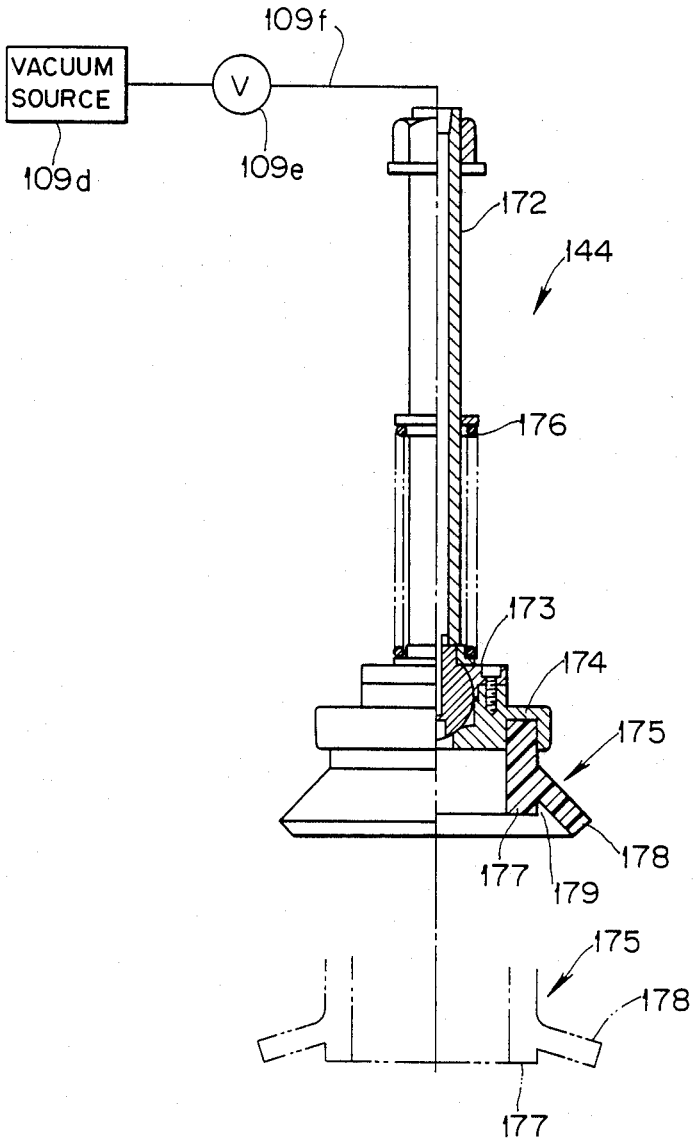
FIG. 13 is an enlarged, partially cross-sectional view showing a suction pad of one of the vacuum-holding heads illustrated in FIGS. 3 and 12.

As shown in detail in FIG. 13, each of the vacuum holders 144 comprises a vertical support pipe 172 having an upper end thereof mounted to the frame 145. A swingable head member 174 is connected to a lower end of the support pipe 172 through a spherical joint 173. A suction pad 175 is fitted into the swingable head member 174. The suction pad 175 is connected to the vacuum source 109*d* through a hollow portion of the support pipe 172 and a suction line 109*f* having provided therein the valve 109*e*. A coil spring 176 arranged about the support pipe 172 is interposed under compression between the support pipe 176 and the swingable head member 174 to bias the same vertically downwardly.

The suction pad 175 is formed of synthetic resin material such as expanded rubber or the like and is molded into a cross-sectional shape as shown in FIG. 13. Specifically, the suction pad 175 has a pair of inner and outer tubular portions 177 and 178 provided in concentric relation to each other in cross-section in a plane perpendicular to an axis common to the inner and outer tubular portions 177 and 178. The outer tubular portion 178 has one end thereof connected in integral relation to the inner tubular portion 177, and the other opening end face. The outer tubular portion 178 is so tapered as to diverge toward its opening end face. The inner and outer tubular portions 177 and 178 cooperate with each other to define therebetween an annular pocket 179 which is variable in volume by resilient deformation of the inner tubular portion 177 and/or the outer tubular portion 178. The opening end face of the outer tubular portion 178 projects beyond an adjacent opening end face of the inner tubular portion 177.

The operation of the bale unpacking system constructed as above will be described below in step order.

Step (a)

Figure 1:
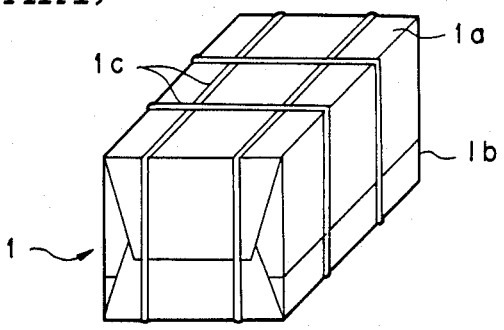
FIG. 1 (PRIOR ART)
FIG. 1 is a perspective view of a conventional pulp bale.
Figure 2:
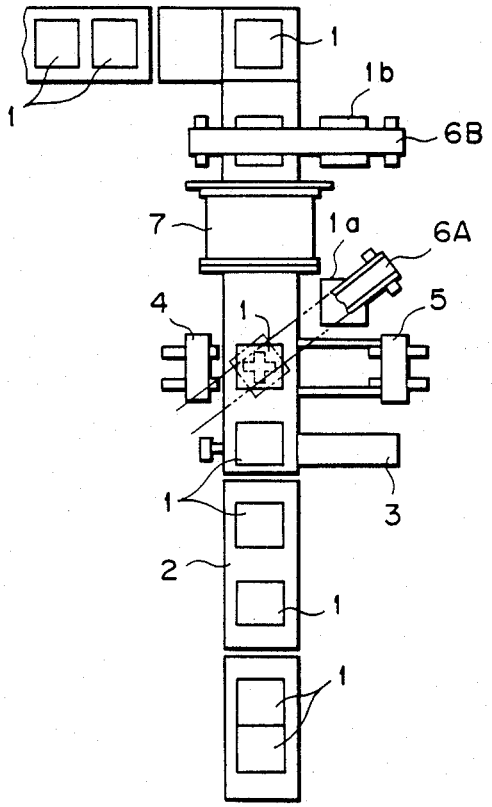
FIG. 2 (PRIOR ART)
FIG. 2 is a top plan view of a conventional system for unpacking the pulp bale illustrated in FIG. 1.

Referring to FIG. 3, the roller conveyer 102 is driven to transport the bales 101 one by one along the predetermined path, that is, in the X-axis direction. The centering device (not shown in FIG. 3, but corresponding to that designated by the reference numeral 3 in FIG. 2) is operated to place the bale 101 in a widthwise central position of the roller conveyer 102. As the bale 101 reaches a position above the bale turner 108, the roller conveyer 102 is halted in operation.

Step (b)

Referring chiefly to FIGS. 4, 7 and 8, the motor 122 of the strap cutting machine 104A is driven to move the body frame 112*a* together with the contact plate member 114 toward the confronting side face 101*e* (FIG. 7) of the bale 101 on the roller conveyer 102, to bring the contact plate member 114 into contact with the confronting side face 101*e* of the bale 101. The motor 122 continues to move the body frame 112*a* toward the confronting side face 101*e* of the bale 101. During this continuing movement of the body frame 112*a*, the rods 113 and 113 connected to the contact plate member 114 are moved in the Y-axis direction to the right as viewed in FIGS. 7 and 8 relatively to the body frame 112*a* while compressing the springs 113*a* and 113*a*. As the rearward end of the rod 113 depresses the actuator pin 153 of the position sensor 151, the position sensor 151 generates a signal representative of the fact that the contact plate member 114 reaches a predetermined position, that is, the magnetic sensors 115 and 115 reaches the predetermined position. The motor 122 is halted in operation in response to the signal from the position sensor 151. At this time, the contact plate member 114 is urged by the springs 131*a* and 131*a* against the confronting side face 101*e* of the bale 101 with a predetermined contact pressure.

Step (c)

The motor 121 is driven to translate the body frame 112*a* together with the contact plate member 114 along the predetermined path, that is, in the X-axis direction while maintaining the pressure contact member 114 in contact with the side face 101*e* of the bale 101, to cause the magnetic sensors 115 and 115 to scan the side face 101*e* of the bale 101 for detecting the position of the pair of straps $\mathbf{101}c_1$ and $\mathbf{101}c_1$ of the bale 101. As one of the magnetic sensors 115 and 115 detects one of the pair of straps $\mathbf{101}c_1$, the motor 121 is halted in operation after the lapse of a predetermined period of time from the time the strap $\mathbf{101}c_1$ is detected, that is, after the lapse of a period of time required for movement of the cutter blades 117 and 118 to a position in front of the strap $\mathbf{101}c_1$. Thus, the cutter blades 117 and 118 are brought to the position in front of the strap $\mathbf{101}c_1$ to be cut. Subsequently, the operation of the bale unpacking system proceeds to a step (d) to be described below.

In connection with the above-mentioned step (c), a case will be described where the bale 101 is mounted on the roller conveyer 102 in such a posture that, as shown in FIG. 7, the side face 101*e* of the bale 101 is inclined with respect to the predetermined path. In this case, the contact plate member 114 is urged by the side face 101*e* of the bale 101, during the scanning of the magnetic sensors 114 and 114, to the right as viewed in FIGS. 7 and 8, that is, in such a direction as to compress the springs 113*a* and 113*a*. The rod 113 depresses the actuator pin 154 of the position sensor 152 so that the position sensor 152 sends the ON-signal to the motor 122. In response to the ON-signal from the position sensor 152, the motor 122 is rendered operative to move the body frame 112*a* to the right, that is, away from the side face 101*e* of the bale 101. Movement of the body frame 112*a* to the right relative to the contact plate member 114 causes the actuator pin 154 of the position sensor 152 to be disengaged from the rearward end of the rod 113, so that the position sensor 152 generates the OFF-signal.

Since the actuator pin 153 of the position sensor 151 is maintained depressed by the rearward end of the rod 113, the OFF-signals are sent from the respective position sensors 151 and 152 to the motor 122 to halt the operation thereof. In this manner, the contact pressure of the contact plate member 114 with the side face 101*e* of the bale 101 due to the springs 113*a* and 113*a* is maintained at the predetermined value.

Step (d)

When the cutter blades 117 and 118 are brought to the position in front of the strap 101*c* of the bale 101 at the above step (c), the motor 122 is driven to move the body frame 112*a* toward the side face 101*e* of the bale 101 while maintaining the contact plate member 114 in contact with the side face 101*e* of the bale 101, to cause the cutter blades 117 and 118 to project forwardly through the opening 116 in the contact plate member 114, thereby bringing the cutter blades 117 and 118 into engagement with the strap 101$c_1$ of the bale 101. An amount of projection of the cutter blades 117 and 118 is detected by a third position sensor (not shown) such as a limit switch which is mounted to the body frame 112*a* at a position between the position sensor 152 and the rearward end of the body frame 112*a* remote from the contact plate member 114. That is, as the body frame 112*a* is moved toward the bale 101 to cause the cutter blades 117 and 118 to project from the contact plate member 114 so that the blades 117 and 118 are brought into engagement with the strap 101$c_1$, an actuator pin of the third position sensor is depressed by the rearward end of the rod 113 to generate a signal. The motor 122 is rendered inoperative in response to the signal from the third position sensor. The hydraulic cylinder 120 is actuated in response to the signal from the third position sensor to close the cutter blades 117 and 118 to cut the strap 101$c_1$.

Step (e)

The above steps (b) through (d) are repeated to cut the other strap 101$c_1$ of the bale 101. Subsequently, the cutting head assembly 112 is moved away from the side face 101*e* of the bale 101.

Step (f)

Referring chiefly to FIGS. 9 and 10, the motor 138 of the strap removing machine 105A is driven to move the body frame 132*a* together with the contact plate member 114 toward the confronting side face of the bale 101 having the cut straps 101*c*, which side face is opposite to the side face 101*e*, to bring the contact plate member 114 into contact with the side face of the bale 101. In a manner like that of the cutter head assembly 112 described above, the guide frame 123 and the movable frame 133 are moved in the X-axis direction, to cause the magnetic sensors 115 and 115 to scan the side face of the bale 101 for detecting the position of the cut straps 101$c_1$ of the bale 101, thereby bringing the clamps 134*a* and 134*b* to a position in front of the cut strap 101$c_1$. The hydraulic cylinder 139 is actuated to cause the clamps 134*a* and 134*b* to clamp the cut strap 101$c_1$. Then, the motor 138 is driven to move the body frame 132*a* away from the bale 101 to the home position. Subsequently, the guide rolls 126B are moved downwardly.

Step (g)

The motor 136 is driven to move the main frame 124 away from the bale 101 along the rails 130 and 130. As the main frame 124 is moved away from the bale 101, the strap 101$c_1$ clamped by the clamps 134*a* and 134*b* is guided by the guide plates 127 and is caused to enter the space between the stationary and movable guide rolls 126A and 126B. The strap 101*c* is pulled outwardly in the Y-axis direction while being in pressure contact with the rolls 126A and 126B. Vertical force resulting from the tension in the strap 101$c_1$ is supported by the upper rail 125 through the guide rolls 126B and the guide frame 123.

Step (h)

The above-mentioned steps (f) and (g) are repeated to draw and remove the pair of straps 101$c_1$ and 101$c_1$ from the bale 101. Subsequently, the bale turner 108 is actuated to turn the bale 101 about the vertical axis through 90 degrees. Then, the operation of the bale unpacking system is returned to the step (b) to cut and remove the remaining two straps 101$c_2$ and 101$c_2$.

Step (i)

The roller conveyer 102 is operated to transport the bale 101 and is halted in operation to stop the bale 101 at a position between the bale inverter 107A and the packaging-sheet removing machine 109. Air is blown against the surface of the first packaging sheet 101*a* of the bale 101 through a plurality of cleaning nozzles (not shown) to blow off dirt and dust from the first packaging sheet 101*a*.

Step (j)

Figure 14:
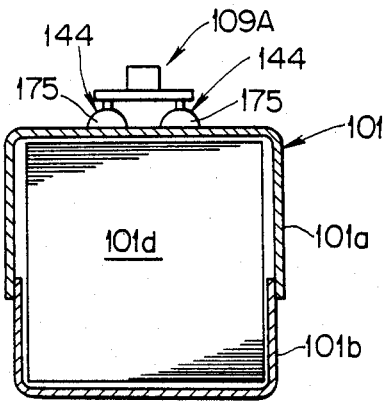
FIGS. 14 through 17 are views showing, in step order, the removing operation of the packaging sheets by the packaging-sheet removing machine illustrated in FIGS. 3 and 12.
Figure 15:
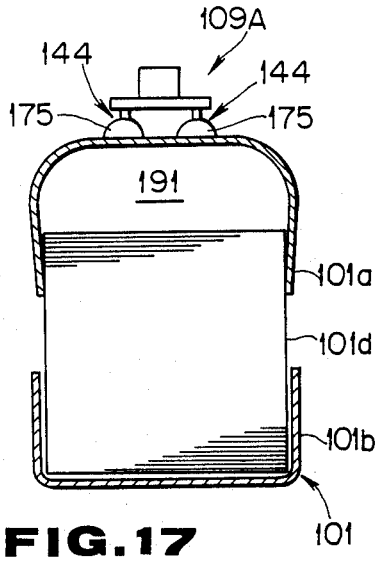
Figure 16:
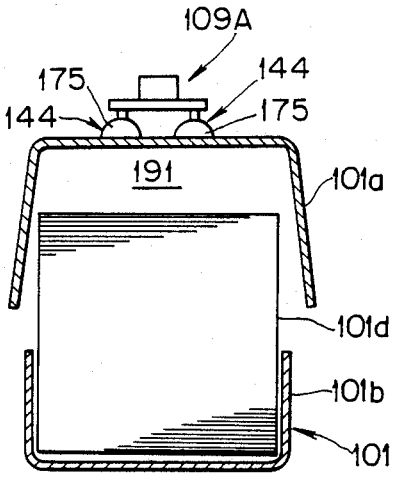
Figure 17:
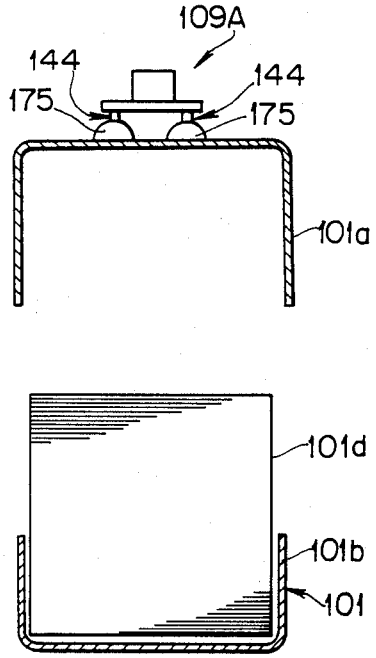

The motor 109*b* of the packaging-sheet removing machine 109 is driven to angularly move the vacuum holding head 109A to the position indicated by the phantom lines in FIG. 3. Then, the valve 109*e* is operated to supply negative pressure from the vacuum source 109*d* to the vacuum holders 144. The motor 109*c* is driven to move the vacuum-holding head 109A downwardly to bring the vacuum holders 144 into engagement with the first packaging sheet 101*a* of the bale 101, as shown in FIG. 14. As the vacuum holders 144 are moved downwardly, the outer tubular portion 178 of each of the suction pads 175 is first brought into contact with the first packaging sheet 101*a*, and is deformed from the condition indicated by the solid lines in FIG. 13 to the condition indicated by the phantom lines in FIG. 13. Subsequently, the inner tubular portion 177 is brought into contact with the first packaging sheet 101*a*. Thus, it is possible to surround a section to be vacuum-held of the first packaging sheet 101*a* double by the inner and outer tubular portions 177 and 178. Accordingly, even if the section to be vacuum held of the first packaging sheet 101*a* has irregularities, it can be ensured to apply the negative pressure to the section to be vacuum-held of the first packaging sheet 101*a*. In addition, since the swingable head 174 of the vacuum holder 144 can be swung about the spherical joint 173 while deforming the coil spring 176, it can further be ensured to bring the suction pad 175 into close contact with the section to be vacuum-held of the first packaging sheet 101*a*. In this manner, the negative pressure is applied to the first packaging sheet 101*a* through the suction pads 175 to attract the first packaging sheet 101*c* to the suction pads 175. The motor 109*c* is driven to move the vacuum-holding head 109A upwardly, as shown in FIG. 15. As the first packaging sheet 101*a* is moved upwardly, a space 191 between the article 101*d* and the first packaging sheet 101*a* to negative pressure so that the opposite sides of the first packaging sheet 101*a* tend to be vacuum-attracted to the respective side faces of the article 101*d*. Accordingly, during upward movement of the vacuum-holding head 109A, the motor 109*c* is driven to move the vacuum-holding head 109A downwardly once to introduce air into the space 191 between the first packaging sheet 101*a* and the article 101*d*, as shown in FIG. 16. Thus, the space 191 between the first packaging sheet 101*a* and the article 101*d* is returned to the normal pressure, so that if the article 101*d* is formed by a stack of sheets, and if some sheets at the top of the article 101*d* are vacuum-attracted to the first packaging sheet 101*a* during upward movement thereof, these sheets fall down onto the top of the stack of sheets. Subsequently, the motor 109*c* is driven to again move the vacuum-holding head 109A upwardly as shown in FIG. 17 to remove the first packaging sheet 101*a* from the article 101*d*. It is to be understood that during upward movement of the first packaging sheet 101*a* to remove the same from the article 101*d*, the first packaging sheet 101*a* may be moved downwardly repeatedly a plurality of times. Then, the motor 109*b* is driven to angularly move the vacuum-holding head 109A to return the same to the position indicated by the solid lines in FIG. 3.

Step (k)

The forks 143 of the bale inverter 107A are operated to clamp the bale 101 having removed therefrom the first packaging sheet 101*a*, and to turn the bale 101 through 180 degrees about the horizontal axis, so that the second packaging sheet 101*b* is located at the top of the bale 101 turned upside down. After the bale 101 has been turned upside down by the bale inverter 107A, the vacuum holders 144 are moved downwardly and are brought into engagement with the second packaging sheet 101*b*, like the first packaging sheet 101*a*. Then, the negative pressure is applied to the second packaging sheet 101*b* through the vacuum holders 144 to attract the second packaging sheet 101*b* to the vacuum holders 144. The vacuum holders 144 are moved upwardly to remove the second packaging sheet 101*b* from the article 101*d*, to thereby unpack the same. In a manner like the first packaging sheet 101*a*, during upward movement of the vacuum holders 144 to remove the second packaging sheet 101*b* from the article 101*d*, the vacuum holders 144 are moved downwardly at least once to introduce air into a space between the second packaging sheet 101*b* and the article 101*d*. The roller conveyer 102 is again operated to transport the unpacked article 101*d* to a location downstream of the packaging-sheet removing machine 109.

Thus, the unpacking operation of the bale 101 is completed.

As described above with reference to FIGS. 14 through 17, the arrangement is such that during upward movement of the packaging sheet material 101*a*, 101*b* from the bale 101, the packaging sheet material is moved downwardly at least once to introduce air into the space between the packaging sheet material and the article 101*d* of the bale 101. With such arrangement, introduction of air into the space between the packaging sheet material and the article 101*d* can release close contact of the packaging sheet material with the article 101*d*, making it possible to quickly move the packaging sheet material upwardly from the article 101*d*. In addition, since the packaging sheet material is not in close contact with the article 101*d*, the packaging sheet material can be prevented from being broken, even if the vacuum holders 144 are rapidly moved upwardly. Moreover, it is also possible to prevent excessive load from being applied to the elevating mechanism for moving the vacuum holders 144 upwardly.

Further, as described above with reference to FIG. 13, each of the suction pads 175 is of double structure having the inner and outer tubular portions 177 and 178, and the opening end face of the outer tubular portion 178 projects beyond the opening end face of the inner tubular portion 177. With such arrangement, even if the surface of the packaging sheet material wrapping up the article 101*d* of the bale 101 is irregular, it can be ensured that the suction pads 175 are brought into close contact with the surface of the packaging sheet material to enable the negative pressure to be applied to the packaging sheet material while preventing air from leaking from the suction pads 175 and the packaging sheet material.

It is to be understood that the suction pads 175 are not limited to the specific configuration illustrated in FIG. 13, but may take any other suitable various configurations, provided that the opening end face of the outer tubular portion 178 projects beyond the adjacent opening end face of the inner tubular portion 177.

Figure 18:
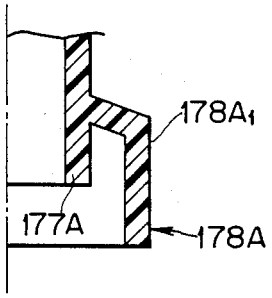
FIG. 18 is a fragmental cross-sectional view of a first variation of the suction pad illustrated in FIG. 13.

FIG. 18 shows a first variation of the suction pad having inner and outer tubular portions 177A and 178A. The outer tubular portion 178A has one end thereof which is connected in integral relation to the inner tubular portion 177A. The outer tubular portion 178A has a wall section 178$A_1$ extending parallel to an axis common to the inner and outer tubular portions 177A and 177B.

Figure 19:
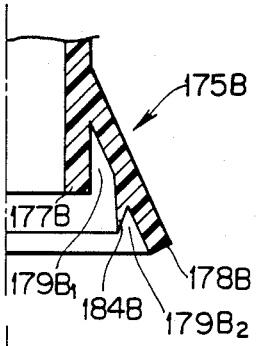
FIG. 19 is a view similar to FIG. 18, but showing a second variation of the suction pad.

FIG. 19 shows a second variation of the suction pad having inner and outer tubular portions 177B and 178B. The outer tubular portion 178B is tapered in a manner like the outer tubular portion 178 illustrated in FIG. 13. The outer tubular portion 178B is provided with an intermediate lip 184B dividing an annular pocket defined between the inner and outer tubular portions 177B and 178B, into two pocket sections 179$B_1$ and 179$B_1$. The intermediate lip 184B is so tapered as to diverge toward the opening end face of the outer tubular portion 178A. The intermediate lip 184B has a free edge projecting beyond the opening end face of the inner tubular portion 177B. The opening end face of the outer tubular portion 178B projects beyond the free edge of the intermediate lip 184B. The intermediate lip 184B is easy to be deformed. Easy deformation of the intermediate lip 184B can ensure close contact of the suction pad 175B with the packaging sheet material of the bale.

Figure 20:
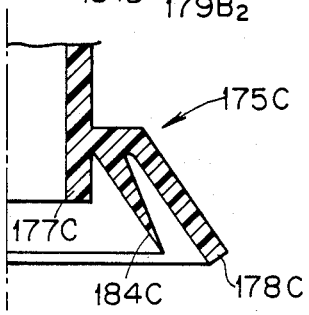
FIG. 20 is a view similar to FIG. 18, but showing a third variation of the suction pad.

FIG. 20 shows a third variation of the suction pad having inner and outer tubular portions 177C and 178C formed in a manner like the suction pad 175B illustrated in FIG. 19. The outer tubular portion 178C is integrally provided with an intermediate lip 184C which has an end opposite to its free edge. The end of the intermediate lip 184C opposite to its free edge is integrally connected to the outer tubular portion 178C adjacent the end thereof integrally connected to the inner tubular portion 177C. The free edge of the intermediate lip 184C extends close to the opening end face of the outer tubular portion 178C, to further ensure close contact of the suction pad 175C with the packaging sheet material of the bale.

Figure 21:
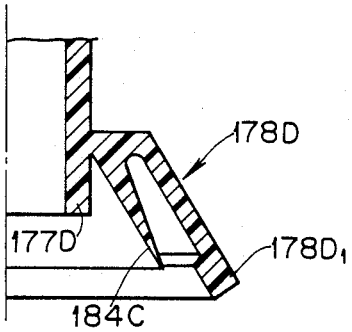
FIG. 21 is a view similar to FIG. 18, but showing a fourth variation of the suction pad.

FIG. 21 shows a fourth variation of the suction pad having inner and outer tubular portions 177D and 178D formed in a manner like those of the suction pad 175C illustrated in FIG. 20. The outer tubular portion 178D has a section 178D$_1$ adjacent to its opening end face, which is thicker in wall thickness than the remaining section. According to the fourth variation, it is possible to facilitate deformation of the outer tubular portion 178D while securing a sufficient contact area of the outer tubular portion 178D with respect to the packaging sheet material of the bale.

Figure 22:
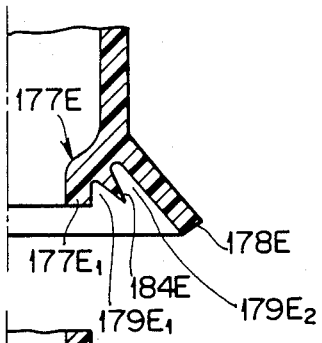
FIG. 22 is a view similar to FIG. 18, but showing a fifth variation of the suction pad.

FIG. 22 shows a fifth variation of the suction pad having inner and outer tubular portions 177E and 178E formed in a manner like those of the suction pad 175 illustrated in FIG. 13. The inner tubular portion 177E has a section 177E$_1$ adjacent its opening end face, which is reduced in diameter. The inner tubular portion 177E is provided with an intermediate lip 184E dividing an annular pocket defined between the inner and outer tubular portions 177E and 178E, into two pocket sections 179E$_1$ and 179E$_2$. The intermediate lip 184E has its free edge substantially in flush with the opening end face of the inner tubular portion 177E.

Figure 23:
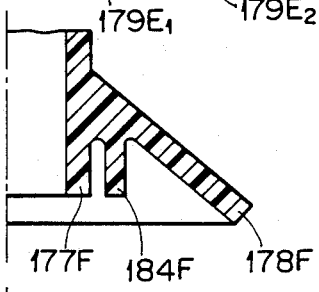
FIG. 23 is a view similar to FIG. 18, but showing a sixth variation of the suction pad.

FIG. 23 shows a sixth variation of the suction pad having inner and outer tubular portions 177F and 178F. The outer tubular portion 178F is integrally provided with an intermediate lip 184F. The intermediate lip 184F extends parallel to the axis common to the inner and outer tubular portions 177F and 178F, and has the free edge substantially in flush with the opening end face of the inner tubular portion 177F.

Figure 24:
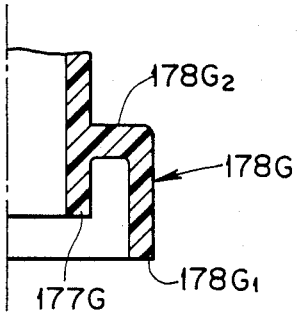
FIG. 24 is a view similar to FIG. 18, but showing a seventh variation of the suction pad.

FIG. 24 shows a seventh variation of the suction pad having inner and outer tubular portions 177G and 178G. The outer tubular portion 178G has a first section 178G$_1$ adjacent its opening end face, which extends parallel to the axis common to the inner and outer tubular portions 177G and 178G. The outer tubular portion 178G further has a second section 178G$_2$ adjacent an end thereof opposite to the opening end face thereof, which extends perpendicularly to the common axis.

Figure 25:
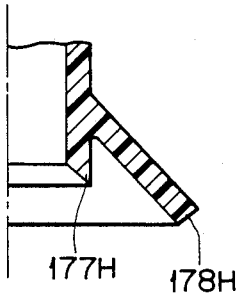
FIG. 25 is a view similar to FIG. 18, but showing an eighth embodiment of the suction pad.

FIG. 25 shows an eighth variation of the suction pad having inner and outer tubular portions 177H and 178H. The inner tubular portion 177H has an opening end face which is so tapered as to diverge toward the opening end face of the outer tubular portion 178H. Thus, the free edge of the inner tubular portion 177H is made easy to be deformed, to enhance close contact of the inner tubular portion 177H with the packaging sheet material of the bale.

Figure 26:
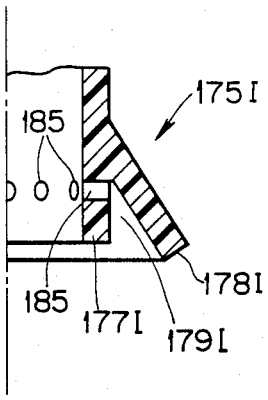
FIG. 26 is a view similar to FIG. 18, but showing a ninth variation of the suction pad.

FIG. 26 shows a ninth variation of the suction pad having inner and outer tubular portions 177I and 178I. The inner tubular portion 177I is provided therein with a plurality of through bores 185 connecting a hollow portion of the inner tubular portion 177I to an annular pocket 179I defined between the inner and outer tubular portions 177I and 178I. Thus, the negative pressure is also applied to the annular pocket 179I, so that the negative pressure is uniformly applied to the packaging sheet material of the bale through the suction pad 175I.

Figure 27:
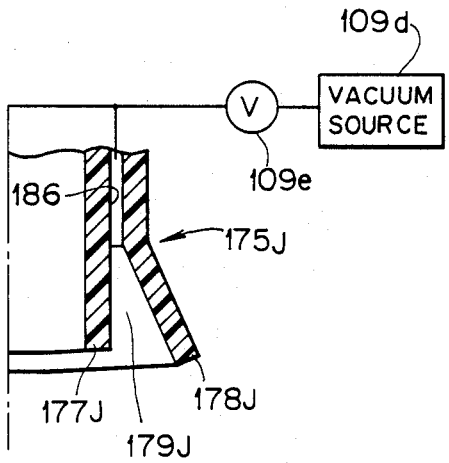
FIG. 27 is a view similar to FIG. 18, but showing a tenth variation of the suction pad.

FIG. 27 shows a tenth variation of the suction pad having inner and outer tubular portions 177J and 178J formed in a manner like those of the suction pad 175 illustrated in FIG. 13. The suction pad 175J is provided therein with a suction passage 186 connecting an annular pocket 179J defined between the inner and outer tubular portions 177J and 178J, to the vacuum source **109*d* through the valve 109*e***.

Figure 28:
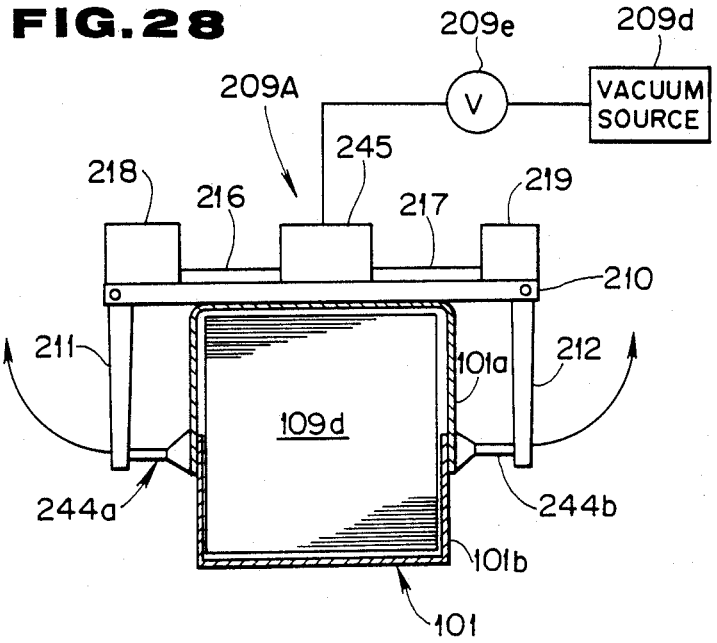
FIG. 28 is a view similar to FIG. 12, but showing a modification of the vacuum-holding head of the packaging-sheet removing machine illustrated in FIG. 3.

FIG. 28 shows a modification of the vacuum-holding head of the packaging-sheet removing machine 109A. The vacuum-holding head 209A comprises a cross bar 210 fixedly mounted to a frame 245 corresponding to the frame 145 shown in FIG. 3, and a pair of arms 211 and 212 connected respectively to opposite ends of the cross bar 210 for pivotal movement toward and away from respective side faces of the bale 101. At least one vacuum holder **244*a* constructed in a manner like the vacuum holder 144 illustrated in FIG. 13 is mounted to the free end of one of the arms 211. Likewise, at least one similar vacuum holder 244*b* is mounted to the free end of the other arm 212. The vacuum holders 244*a* and 244*b* are connected to a vacuum source 209*d* through hollow portions of the respective arms 211 and 212 and respective suction lines 216 and 217, and through a valve 209*e*. A pair of motors 218 and 219 are mounted on the cross bar 210 for pivotally moving the respective arms 211 and 212**.

The arrangement illustrated in FIG. 28 is such that the vacuum holders **244*a* and 244*b* are angularly moved into engagement with the respective side faces of the first packaging sheet 101*a*. The negative pressure from the vacuum source 209*d* is applied to the side faces of the first packaging sheet 101*a* through the respective vacuum holders 244*a* and 244*b* to attract the side faces of the first packaging sheet 101*a* to the respective vacuum holders 244*a* and 244*b*. Vacuum holders 244*a* and 244*b* are angularly moved by the respective motors 218 and 219 away from the respective side faces of the article 101*d*. Then, the vacuum-holding head 209A is moved upwardly to remove the first packaging sheet 101*a* from the article 101*d*. The bale inverter 107A shown in FIG. 3 turns the bale 101 upside down. The vacuum-holding head 209A is moved downwardly, and the vacuum holders 244*a* and 244*b* are angularly moved by the respective motors 218 and 219 toward the respective side faces of the article 101*d* to bring the vacuum holders 244*a* and 244*b* into engagement respective opposite side faces of the second packaging sheet 101*b*. The negative pressure from the vacuum source 209*d* is applied to the side faces of the second packaging sheet 101*b* through the respective vacuum holders 244*a* and 244*b* to attract the side faces of the second packaging sheet 101*b* to the respective vacuum holders 244*a* and 244*b*. The vacuum holders 244*a* and 244*b* are angularly moved by the respective motors 218 and 219 away from the respective side faces of the article 101*d*. The vacuum-holding head 209A is then moved upwardly to remove the second packaging sheet 101*b* from the article 101*d***.

As described above in detail, the arrangement of the invention is such that the second drive means or the motor 122, 138 moves the body frame **112*a*, 132*a* together with the contact plate member 114 toward the side face of the bale 101 to bring the contact plate member 114 into contact with the side face of the bale 101, and the second drive means 122, 138 continues to move the body frame 112*a*, 132*a* toward the side face of the bale 101 while increasing biasing force of the biasing means or the springs 113*a* until the body frame 112*a*, 132*a* moves to a predetermined position relative to the contact plate member 114 where the contact plate member 114 is urged by the biasing means 113*a* against the side face of the bale 101 with a predetermined contact pressure, that the detecting means or the position detector 150 detects movement of the body frame 112***a*, 132*a* to the predetermined position, to generate a first signal, and the second drive means 122, 138 is rendered inoperative in response to the first signal from the detecting means 150 to halt movement of the body frame 112*a*, 132*a* toward the side face of the bale 101, that the first drive means or the motor 121, 137 translates the movable frame 111, 133 together with the body frame 112*a*, 132*a* and the contact plate member 114 along the predetermined path while maintaining the pressure contact member 114 in contact with the side face of the bale 101, to cause the sensor means or the magnetic sensors 115 to scan the side face of the bale 101 for detecting the position of the strap 101*c* of the bale 101, that when the contact plate member 114 is urged by the side face of the bale 101, during the scanning of the sensor means 115, and is moved relatively to the body frame 112*a*, 132*a* in such a direction as to increase the biasing force of the biasing means 113*a*, the detecting means 150 detects the movement of the contact plate member 114 relative to the body frame 112*a*, 132*a* to generate a second signal, and the second drive means 122, 138 is rendered operative in response to the second signal from the detecting means 150 to move the body frame 112*a*, 132*a* away from the side face of the bale 101 to the predetermined position, thereby maintaining the predetermined contact pressure, and that when the sensor means 115 detects the position of the strap 101*c* of the bale 101 to generate a signal, the second drive means 122, 138 is rendered operative in response to the signal from the sensor means 115 to move the body frame 112*a*, 132*a* toward the side face of the bale 101 while maintaining the contact plate member 114 in contact with the side face of the bale 101, to bring the strap handling means or cutter blades 117 and 118 or clamps 134*a* and 134*b* into engagement with the strap 101*c* of the bale 101. With such arrangement of the invention, it is possible to maintain constant the contact pressure between the bale 101 and the contact plate member 114 or between the bale 101 and the sensor means 115.

What is claimed is:

1. A method of unpacking bales each having an article, a packaging sheet material wrapping up the article and at least one strap extending around the article in a vertical plane to tie the article through the packaging sheet material, said method comprising the steps of:

(a) transporting the bales one by one along a predetermined path;

(b) cutting the strap of the bale on said predetermined path;

(c) removing the cut strap from the bale; and (d) removing the packaging sheet material from the bale having removed therefrom the strap, to expose the article, wherein at least one of said steps (b) and (c) includes the steps of:

(i) preparing a body frame capable of being translated along said predetermined path and movable toward and away from a side face of the bale on the predetermined path, the side face being confronted with said body frame, strap handling means mounted on said body frame for handling the strap of the bale, a contact plate member mounted on said body frame for movement relative thereto toward and away from the side face of the bale, biasing means mounted between said contact plate member and said body frame for biasing said contact plate member relatively to said body frame toward the side face of the bale, and sensor means mounted on said contact plate member for detecting a position of the strap of the bale;

(ii) moving said body frame together with said contact plate member toward the side face of the bale to bring said contact plate member into contact with the side face of the bale, continuing to move said body frame toward the side face of the bale while increasing biasing force of said biasing means until contact pressure, with which said contact plate member is urged by said biasing means against the side face of the bale, reaches a predetermined value, and halting movement of said body frame toward the side face of the bale when said contact pressure reaches said predetermined value;

(iii) translating said body frame together with said contact plate member along said predetermined path while maintaining said contact plate member in contact with the side face of the bale, to cause said sensor means to scan the side face of the bale for detecting the position of the strap of the bale;

(iv) when said contact plate member is urged by the side face of the bale, during the scanning of said sensor means, in such a direction as to increase the biasing force of said biasing means, moving said body frame away from the side face of the bale to maintain said contact pressure at said predetermined value; and (v) when said sensor means detects the position of the strap of the bale, moving said body frame toward the side face of the bale while maintaining said contact plate member in contact with the side face of the bale, to bring said strap handling means into engagement with the strap of the bale.

2. A method as defined in claim 1, wherein said step (b) includes said steps (i) through (v), and wherein said strap handing means comprises a cutter for cutting the strap of the bale.

3. A method as defined in claim 1, wherein said step (c) includes said steps (i) through (v), and wherein said strap handling means comprises clamps for clamping the strap of the bale.

4. A method as defined in claim 1, wherein each of said steps (b) and (c) includes said steps (i) through (v), wherein the strap handing means used in said step (b) comprises a cutter for cutting the strap of the bale, and wherein the strap handling means used in said step (c) comprises clamps for clamping the strap of the bale.

5. A method as defined in claim 1, wherein the bale has the article, the packaging sheet material wrapping up the article and a plurality of straps extending around the article to tie the same through the packaging sheet material, the straps including at least one strap extending in a first vertical plane and at least one strap extending in a second vertical plane perpendicular to the first vertical plane, and wherein said steps (b) and (c) include the steps of:

cutting the strap extending in the first vertical plane;

removing the cut strap in the first vertical plane, from the bale;

turning the bale about a vertical axis through 90 degrees;

cutting the strap extending in the second vertical plane; and removing the cut strap in the second vertical plane, from the bale.

6. A method as defined in claim 1, wherein said step (d) includes the steps of:

moving the packaging sheet material upwardly from the article; and moving the packaging sheet material downwardly at least once during the upward movement of the packaging sheet material, to introduce air into a space between the packaging sheet material and the article.

7. A method as defined in claim 1, wherein the packaging sheet material has a first packaging sheet wrapping up an upper portion of the article and a second packaging sheet wrapping up a lower portion of the article, and wherein said step (d) includes the steps of:

removing the first packaging sheet from the article;

turning, upside down, the bale having removed therefrom the first packing sheet; and removing the second packaging sheet from the article.

8. A method as defined in claim 7, wherein said step (d) includes the steps of:

preparing at least one vacuum holder;

applying negative pressure to the first packaging sheet through said vacuum holder to attract the first packaging sheet to said vacuum holder;

moving said vacuum holder upwardly to remove the first packaging sheet from the article;

during upward movement of said vacuum holder to remove the first packaging sheet from the article, moving said vacuum holder downwardly at least once to introduce air into a space between the first packaging sheet and the article;

after the bale has been turned upside down, moving said vacuum holder downwardly to bring the same into engagement with the second packaging sheet;

applying negative pressure to the second packaging sheet through said vacuum holder to attract the second packaging sheet to said vacuum holder;

moving said vacuum holder upwardly to remove the second packaging sheet from the article; and during upward movement of said vacuum holder to remove the second packaging material from the article, moving said vacuum holder downwardly at least once to introduce air into a space between the second packaging material and the article.

9. A method as defined in claim 7, wherein said step (d) includes the steps of:

preparing at least two vacuum holders;

applying negative pressure to opposite side faces of the first packaging sheet through the respective vacuum holders to attract the side faces of the first packaging sheet to the respective vacuum holders;

angularly moving said vacuum holders having attracted thereto the respective side faces of the first packaging sheet, away from respective opposite side faces of the article to remove the first packaging sheet from the article;

after the bale has been turned upside down, angularly moving said vacuum holders toward the respective side faces of the article to bring said vacuum holders into engagement with respective opposite side faces of the second packaging sheet;

applying negative pressure to the side faces of the second packaging sheet through the respective vacuum holders to attract the side faces of the second packaging sheet to the respective vacuum holders; and angularly moving said vacuum holders having attracted thereto the respective side faces of the second packaging sheet, away from respective opposite side faces of the article to remove the second packaging sheet from the article.

10. A method as defined in claim 1, wherein the strap is formed by a metallic band, and said sensor means comprises a pair of magnetic sensors.

11. A method as defined in claim 1, wherein the bale is a pulp bale having the article formed by a stack of pulp sheets.

12. A system for unpacking bales each having an article, a packaging sheet material wrapping up the article and at least one strap extending around the article in a vertical plane to tie the article through the packaging sheet material, said system comprising:

means for transporting the bales one by one along a predetermined path;

cutting means arranged in facing relation to said predetermined path for cutting the strap of the bale on said predetermined path;

strap removing means arranged in facing relation to said predetermined path for removing the cut strap from the bale; and packaging-sheet removing means for removing the packaging sheet material from the bale having removed therefrom the strap, wherein at least one of said cutting means and said strap removing means includes an operating apparatus which comprises:

a movable frame capable of being translated along said predetermined path;

a body frame mounted on said movable frame for movement relative thereto toward and away from a side face of the bale on the predetermined path, the side face being confronted with said body frame;

strap handling means mounted on said body frame for handling the strap of the bale;

a contact plate member mounted on said body frame for movement relative thereto toward and away from the side face of the bale;

biasing means mounted between said contact plate member and said body frame for biasing said contact plate member relatively to said body frame toward the side face of the bale;

sensor means mounted on said contact plate member for detecting a position of the strap of the bale;

detecting means for detecting a position of said contact plate member relative to said body frame;

first drive means for translating said movable frame along said predetermined path; and second drive means for moving said body frame relatively to said movable frame toward and away from the side face of the bale, wherein said second drive means moves said body frame together with said contact plate member toward the side face of the bale to bring said contact plate member into contact with the side face of the bale, and said second drive means continues to move said body frame toward the side face of the bale while increasing biasing force of said biasing means until said body frame moves to a predetermined position relative to said contact plate member where said contact plate member is urged by said biasing means against the side face of the bale with a predetermined contact pressure, wherein said detecting means detects movement of said body frame to said predetermined position, to generate a first signal, and said second drive means is rendered inoperative in response to the first signal from said detecting means to halt movement of said body frame toward the side face of the bale, wherein said first drive means translates said movable frame together with said body frame and said contact plate member along said predetermined path while maintaining said pressure contact member in contact with the side face of the bale, to cause said sensor means to scan the side face of the bale for detecting the position of the strap of the bale, wherein when said contact plate member is urged by the side face of the bale, during the scanning of said sensor means, and is moved relatively to said body frame in such a direction as to increase the biasing force of said biasing means, said detecting means detects the movement of said contact plate member relative to said body frame to generate a second signal, and said second drive means is rendered operative in response to the second signal from said detecting means to move said body frame away from the side face of the bale to said predetermined position, thereby maintaining said predetermined contact pressure, and wherein when said sensor means detects the position of the strap of the bale to generate a signal, said second drive means is rendered operative in response to the signal from said sensor means to move said body frame toward the side face of the bale while maintaining said contact plate member in contact with the side face of the bale, to bring said strap handling means into engagement with the strap of the bale.

13. A system as defined in claim 12, wherein said cutting means includes said operating apparatus, and wherein said strap handing means comprises a cutter for cutting the strap of the bale.

14. A system as defined in claim 12, wherein said strap removing means includes said operating apparatus, and wherein said strap handling means comprises clamps for clamping the strap of the bale.

15. A system as defined in claim 12, wherein each of said cutting means and said strap removing means includes said operating apparatus, wherein the strap handling means of the operating apparatus in said cutting means comprises a cutter for cutting the strap of the bale, and wherein the strap handling means of the operating apparatus in said strap removing means comprises clamps for clamping the strap of the bale.

16. A system as defined in claim 12, wherein said operating apparatus includes a pair of rods having their respective axes extending perpendicularly to said predetermined path, said pair of rods having their respective one ends connected to said contact plate member, said pair of rods being supported by said body frame for movement relative thereto toward and away from the side face of the bale, said biasing means comprising a pair of springs interposed between the respective rods and said body frame.

17. A system as defined in claim 16, wherein said contact plate member is connected to the one ends of the respective rods for pivotal movement about a horizontal axis extending parallel to said predetermined path.

18. A system as defined in claim 12, wherein the bale has the article, the packaging sheet material wrapping up the article and a plurality of straps extending around the article to tie the same through the packaging sheet material, the straps including at least one strap extending in a first vertical plane and at least one strap extending in a second vertical plane perpendicular to the first vertical plane, and wherein said system includes turning means for turning the bale about a vertical axis through 90 degrees, the arrangement being such that said cutting means cuts the strap extending in the first vertical plane, said strap removing means removes the cut strap in the first vertical plane, from the bale, said turning means turns the bale about the vertical axis through 90 degrees, said cutting means cuts the strap extending in the second vertical plane, and said strap removing means removes the cut strap in the second vertical plane, from the bale.

19. A system as defined in claim 12, wherein the packaging sheet material has a first packaging sheet wrapping up an upper portion of the article and a second packaging sheet wrapping up a lower portion of the article, wherein said system includes inverting means for turning the bale upside down, and wherein said packaging-sheet removing means includes;

at least one vacuum holder;

suction means connected to said vacuum holder for supplying negative pressure to the same; and elevating means for moving said vacuum holder vertically toward and away from the bale, the arrangement being such that said elevating means moves said vacuum holder downwardly to bring the same into engagement with a top of the bale, said suction means applies the negative pressure to the first packaging sheet through said vacuum holder to attract the first packaging sheet to said vacuum holder, said elevating means moves said vacuum holder upwardly to remove the first packaging sheet from the article, said inverting means turns the bale upside down, said elevating means moves said vacuum holder downwardly to bring the same into engagement with a top of the bale turned upside down, said suction means applies the negative pressure to the second packaging sheet through said vacuum holder to attract the second packaging sheet to said vacuum holder, and said elevating means moves said vacuum holder upwardly to remove the second packaging sheet from the article.

20. A system as defined in claim 19, wherein said vacuum holder includes a resiliently deformable suction pad having a pair of inner and outer tubular portions provided in concentric relation to each other in cross-section in a plane perpendicular to an axis common to said inner and outer tubular portions, said inner and outer tubular portions cooperating with each other to define therebetween an annular pocket, said outer tubular portion having one end thereof connected to said inner tubular section and the other opening end face which projects beyond an adjacent opening end face of said inner tubular portion.

21. A system as defined in claim 20, wherein said one end of said outer tubular portion is connected in integral relation to said inner tubular portion, said outer tubular portion being so tapered as to diverge toward said opening end face of said outer tubular portion.

22. A system as defined in claim 20, wherein said one end of said outer tubular portion is connected in integral relation to said inner tubular portion, said outer tubular portion having a wall section extending parallel to the axis common to said inner and outer tubular portions.

23. A system as defined in claim 21, wherein said outer tubular portion is provided with an intermediate lip dividing said annular pocket into two pocket sections, said intermediate lip having a free edge projecting beyond said opening end face of said inner tubular portion, and said opening end face of said outer tubular portion projecting beyond the free end of said intermediate lip.

24. A system as defined in claim 23, wherein said intermediate lip has the other end opposite to its free edge, said other end of said intermediate lip being connected to said outer tubular portion adjacent said one end thereof.

25. A system as defined in claim 24, wherein said outer tubular portion has a section adjacent its opening end face, which is thicker in wall thickness than the remaining section.

26. A system as defined in claim 21, wherein said inner tubular portion has a section adjacent its opening end face, which is reduced in diameter, said inner tubular portion being provided with an intermediate lip dividing said annular pocket into two pocket sections, said intermediate lip having its free edge substantially in flush with said opening end face of said inner tubular portion.

27. A system as defined in claim 24, wherein said intermediate lip extends parallel to the axis common to said inner and outer tubular portions, and has the free edge substantially in flush with said opening end face of said inner tubular portion.

28. A system as defined in claim 20, wherein said outer tubular portion has a first section adjacent its opening end face, which extends parallel to the axis common to said inner and outer tubular portions, and a second section adjacent said one end of said outer tubular portion, which extends perpendicularly to the common axis.

29. A system as defined in claim 20, wherein said opening end face of said inner tubular portion is so tapered as to diverge toward said opening end face of said outer tubular portion.

30. A system as defined in claim 20, wherein said inner tubular portion is provided therein with a plurality of through bores connecting a hollow portion of said inner tubular portion to said annular pocket.

31. A system as defined in claim 20, wherein said suction pad is provided therein with a suction passage connecting said annular pocket to said suction means.

32. A system as defined in claim 12, wherein said packaging sheet material has a first packaging sheet wrapping up an upper portion of the article and a second packaging sheet wrapping up a lower portion of the article, wherein said system includes inverting means for turning the bale upside down, and wherein said packaging-sheet removing means includes;

at least two vacuum holders angularly movable respectively toward and away from opposite side faces of the bale; and suction means connected to said vacuum holders for supplying negative pressure to the same, the arrangement being such that said vacuum holders are angularly moved and are brought into engagement with respective opposite side faces of the first packaging sheet, said suction means applies the negative pressure to the side faces of the first packaging sheet through the respective vacuum holders to attract the side faces of the first packaging sheet to the respective vacuum holders, said vacuum holders are angularly moved away from respective side faces of the article to remove the first packaging sheet from the article, said inverting means turns the bale upside down, said vacuum holders are angularly moved toward respective opposite side faces of the article to bring said vacuum holders into engagement with respective opposite side faces of the second packaging sheet, said suction means applies the negative pressure to the side faces of the second packaging sheet through the respective vacuum holders to attract the opposite side faces of the second packaging sheet to the respective vacuum holders, and said vacuum holders are angularly moved away from the respective side faces of the article to remove the second packaging sheet from the article.

33. A system as defined in claim 12, wherein the strap is formed by a metallic band, and said sensor means comprises a pair of magnetic sensors.

34. A system as defined in claim 12, wherein the bale is a pulp bale having the article formed by a stack of pulp sheets.

* * * * *